US010309166B2

(12) United States Patent
Thiemann et al.

(10) Patent No.: US 10,309,166 B2
(45) Date of Patent: Jun. 4, 2019

(54) GENSET FOR TOP DRIVE UNIT

(71) Applicant: Weatherford Technology Holdings, LLC, Houston, TX (US)

(72) Inventors: Bjoern Thiemann, Burgwedel (DE); Frank Wern, Hannover (DE); John Fielding Ownby, Houston, TX (US); Aicam Zouhair, Houston, TX (US); Martin Liess, Seelze (DE); Christina Karin Hebebrand, Hannover (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 15/258,752

(22) Filed: Sep. 7, 2016

(65) Prior Publication Data

US 2017/0067303 A1 Mar. 9, 2017

Related U.S. Application Data

(60) Provisional application No. 62/215,503, filed on Sep. 8, 2015.

(51) Int. Cl.
*E21B 19/06* (2006.01)
*E21B 19/14* (2006.01)
(Continued)

(52) U.S. Cl.
CPC ..... *E21B 19/06* (2013.01); *E21B 3/02* (2013.01); *E21B 19/14* (2013.01); *E21B 19/16* (2013.01);
(Continued)

(58) Field of Classification Search
CPC ..... E21B 19/06; E21B 19/14; E21B 19/16; E21B 3/02; E21B 33/05; E21B 33/068; E21B 33/14; E21B 44/00
See application file for complete search history.

(56) References Cited

U.S. PATENT DOCUMENTS 1,367,156 A 2/1921 McAlvay et al.
1,610,977 A 12/1926 Scott
(Continued)

FOREIGN PATENT DOCUMENTS

AU 2012201644 A1 4/2012
AU 2012201644 * 12/2012 ..... E21B 3/02
(Continued)

OTHER PUBLICATIONS

"Fundamentals of Hydraulic Motors," Staff Report, Hydraulics and Pneumatics, Jun. 26, 2014, http://hydraulicspneumatics.com/hydraulic-pumps-motors/fundamentals-hydraulic-motors, accessed Aug. 12, 2015.

(Continued)

*Primary Examiner* — Giovanna C Wright
*Assistant Examiner* — Dany E Akakpo
(74) *Attorney, Agent, or Firm* — Patterson + Sheridan, LLP

(57) ABSTRACT

A system includes an accessory tool selected from a group consisting of a casing unit, a cementing unit, and a drilling unit; and a genset mounted to the accessory tool and comprising: a fluid driven motor having an inlet and an outlet for connection to a control swivel of the system; an electric generator connected to the fluid driven motor; a manifold having an inlet for connection to the control swivel and an outlet connected an accessory tool actuator; and a control unit in communication with the electric generator and the manifold and comprising a wireless data link.

27 Claims, 15 Drawing Sheets

(51) Int. Cl.

| | |
|---|---|
| ***E21B 33/05*** | (2006.01) |
| ***E21B 33/068*** | (2006.01) |
| ***F01C 1/10*** | (2006.01) |
| ***F01C 13/00*** | (2006.01) |
| ***F01C 21/00*** | (2006.01) |
| ***F01C 21/18*** | (2006.01) |
| ***E21B 33/14*** | (2006.01) |
| ***E21B 3/02*** | (2006.01) |
| ***E21B 19/16*** | (2006.01) |

(52) U.S. Cl.

CPC ..... *E21B 33/05* (2013.01); *E21B 33/068* (2013.01); *E21B 33/14* (2013.01); *F01C 1/103* (2013.01); *F01C 13/00* (2013.01); *F01C 21/008* (2013.01); *F01C 21/18* (2013.01)

(56) References Cited

U.S. PATENT DOCUMENTS 1,822,444 A 9/1931 MacClatchie
2,370,354 A 2/1945 Hurst
3,147,992 A 9/1964 Haeber et al.
3,354,951 A 11/1967 Savage et al.
3,385,370 A 5/1968 Knox et al.
3,662,842 A 5/1972 Bromell
3,698,426 A 10/1972 Litchfield et al.
3,747,675 A 7/1973 Brown
3,766,991 A 10/1973 Brown
3,776,320 A 12/1973 Brown
3,842,619 A 10/1974 Bychurch, Sr.
3,888,318 A 6/1975 Brown
3,899,024 A 8/1975 Tonnelli et al.
3,913,687 A 10/1975 Gyongyosi et al.
3,915,244 A 10/1975 Brown
3,964,552 A 6/1976 Slator
4,022,284 A * 5/1977 Crow ..... E02F 9/028 173/2
4,051,587 A 10/1977 Boyadjieff
4,100,968 A 7/1978 Delano
4,192,155 A 3/1980 Gray
4,199,847 A 4/1980 Owens
4,235,469 A 11/1980 Denny et al.
4,364,407 A 12/1982 Hilliard
4,377,179 A 3/1983 Giebeler
4,402,239 A 9/1983 Mooney
4,449,596 A 5/1984 Boyadjieff
4,478,244 A 10/1984 Garrett
4,497,224 A 2/1985 Jürgens
4,593,773 A 6/1986 Skeie
4,762,187 A 8/1988 Haney
4,776,617 A 10/1988 Sato
4,779,688 A 10/1988 Baugh
4,791,997 A 12/1988 Krasnov
4,813,493 A 3/1989 Shaw et al.
4,815,546 A 3/1989 Haney et al.
4,821,814 A 4/1989 Willis et al.
4,844,181 A 7/1989 Bassinger
4,867,236 A 9/1989 Haney et al.
4,955,949 A 9/1990 Bailey et al.
4,962,819 A 10/1990 Bailey et al.
4,972,741 A 11/1990 Sibille
4,981,180 A 1/1991 Price
4,997,042 A 3/1991 Jordan et al.
5,036,927 A 8/1991 Willis
5,099,725 A 3/1992 Bouligny, Jr. et al.
5,152,554 A 10/1992 LaFleur et al.
5,172,940 A 12/1992 Usui et al.
5,191,939 A 3/1993 Stokley
5,215,153 A 6/1993 Younes
5,245,877 A 9/1993 Ruark
5,282,653 A 2/1994 LaFleur et al.
5,297,833 A 3/1994 Willis et al.
5,348,351 A 9/1994 LaFleur et al.
5,385,514 A 1/1995 Dawe
5,433,279 A 7/1995 Tessari et al.
5,441,310 A 8/1995 Barrett et al.
5,456,320 A 10/1995 Baker
5,479,988 A 1/1996 Appleton
5,486,223 A 1/1996 Carden
5,501,280 A 3/1996 Brisco
5,509,442 A 4/1996 Claycomb
5,577,566 A 11/1996 Albright et al.
5,584,343 A 12/1996 Coone
5,645,131 A 7/1997 Trevisani
5,664,310 A 9/1997 Penisson
5,682,952 A 11/1997 Stokley
5,735,348 A 4/1998 Hawkins, III
5,778,742 A 7/1998 Stuart
5,839,330 A 11/1998 Stokka
5,909,768 A 6/1999 Castille et al.
5,918,673 A 7/1999 Hawkins et al.
5,950,724 A 9/1999 Giebeler
5,971,079 A 10/1999 Mullins
5,992,520 A 11/1999 Schultz et al.
6,003,412 A 12/1999 Dlask et al.
6,053,191 A 4/2000 Hussey
6,102,116 A 8/2000 Giovanni
6,142,545 A 11/2000 Penman et al.
6,161,617 A 12/2000 Gjedebo
6,173,777 B1 1/2001 Mullins
6,276,450 B1 8/2001 Seneviratne
6,279,654 B1 8/2001 Mosing et al.
6,289,911 B1 9/2001 Majkovic
6,309,002 B1 10/2001 Bouligny
6,311,792 B1 11/2001 Scott et al.
6,328,343 B1 12/2001 Hosie et al.
6,378,630 B1 4/2002 Ritorto et al.
6,390,190 B2 5/2002 Mullins
6,401,811 B1 6/2002 Coone
6,415,862 B1 7/2002 Mullins
6,431,626 B1 8/2002 Bouligny
6,443,241 B1 9/2002 Juhasz et al.
6,460,620 B1 10/2002 LaFleur
6,527,047 B1 3/2003 Pietras
6,536,520 B1 3/2003 Snider et al.
6,571,876 B2 6/2003 Szarka
6,578,632 B2 6/2003 Mullins
6,595,288 B2 7/2003 Mosing et al.
6,604,578 B2 8/2003 Mullins
6,622,796 B1 9/2003 Pietras
6,637,526 B2 10/2003 Juhasz et al.
6,640,824 B2 11/2003 Majkovic
6,666,273 B2 12/2003 Laurel
6,675,889 B1 1/2004 Mullins et al.
6,679,333 B2 1/2004 York et al.
6,688,398 B2 2/2004 Pietras
6,691,801 B2 2/2004 Juhasz et al.
6,705,405 B1 3/2004 Pietras
6,715,542 B2 4/2004 Mullins
6,719,046 B2 4/2004 Mullins
6,722,425 B2 4/2004 Mullins
6,725,938 B1 4/2004 Pietras
6,732,819 B2 5/2004 Wenzel
6,732,822 B2 5/2004 Slack et al.
6,742,584 B1 6/2004 Appleton
6,742,596 B2 6/2004 Haugen
6,779,599 B2 8/2004 Mullins et al.
6,832,656 B2 12/2004 Fournier, Jr. et al.
6,883,605 B2 4/2005 Arceneaux et al.
6,892,835 B2 5/2005 Shahin et al.
6,908,121 B2 6/2005 Hirth et al.
6,925,807 B2 8/2005 Jones et al.
6,938,697 B2 9/2005 Haugen
6,976,298 B1 12/2005 Pietras
6,994,176 B2 2/2006 Shahin et al.
7,000,503 B2 2/2006 Dagenais et al.
7,001,065 B2 2/2006 Dishaw et al.
7,004,259 B2 2/2006 Pietras
7,007,753 B2 3/2006 Robichaux et al.
7,017,671 B2 3/2006 Williford
7,021,374 B2 4/2006 Pietras
7,025,130 B2 4/2006 Bailey et al.
7,073,598 B2 7/2006 Haugen

(56) References Cited

U.S. PATENT DOCUMENTS 7,090,021 B2 8/2006 Pietras
7,096,948 B2 8/2006 Mosing et al.
7,114,235 B2 10/2006 Jansch et al.
7,128,161 B2 10/2006 Pietras
7,137,454 B2 11/2006 Pietras
7,140,443 B2 11/2006 Beierbach et al.
7,143,849 B2 12/2006 Shahin et al.
7,147,254 B2 12/2006 Niven et al.
7,159,654 B2 1/2007 Ellison et al.
7,178,612 B2 2/2007 Belik
7,213,656 B2 5/2007 Pietras
7,219,744 B2 5/2007 Pietras
7,231,969 B2 6/2007 Folk et al.
7,270,189 B2 9/2007 Brown et al.
7,281,451 B2 10/2007 Schulze Beckinghausen
7,281,587 B2 10/2007 Haugen
7,303,022 B2 12/2007 Tilton et al.
7,325,610 B2 2/2008 Giroux et al.
7,353,880 B2 4/2008 Pietras
7,448,456 B2 11/2008 Shahin et al.
7,451,826 B2 11/2008 Pietras
7,490,677 B2 2/2009 Buytaert et al.
7,503,397 B2 3/2009 Giroux et al.
7,509,722 B2 3/2009 Shahin et al.
7,513,300 B2 4/2009 Pietras et al.
7,591,304 B2 9/2009 Juhasz et al.
7,617,866 B2 11/2009 Pietras
7,635,026 B2 12/2009 Mosing et al.
7,665,515 B2 2/2010 Mullins
7,665,530 B2 2/2010 Wells et al.
7,665,531 B2 2/2010 Pietras
7,690,422 B2 4/2010 Swietlik et al.
7,694,730 B2 4/2010 Angman
7,694,744 B2 4/2010 Shahin
7,699,121 B2 4/2010 Juhasz et al.
7,712,523 B2 5/2010 Snider et al.
7,730,698 B1 6/2010 Montano et al.
7,757,759 B2 7/2010 Jahn et al.
7,779,922 B1 8/2010 Harris et al.
7,793,719 B2 9/2010 Snider et al.
7,817,062 B1 10/2010 Li et al.
7,828,085 B2 11/2010 Kuttel et al.
7,841,415 B2 11/2010 Winter
7,854,265 B2 12/2010 Zimmermann
7,866,390 B2 1/2011 Latiolais, Jr. et al.
7,874,352 B2 1/2011 Odell, II et al.
7,874,361 B2 1/2011 Mosing et al.
7,878,237 B2 2/2011 Angman
7,878,254 B2 2/2011 Abdollahi et al.
7,882,902 B2 2/2011 Boutwell, Jr.
7,896,084 B2 3/2011 Haugen
7,918,273 B2 4/2011 Snider et al.
7,958,787 B2 6/2011 Hunter
7,971,637 B2 7/2011 Duhon et al.
7,975,768 B2 7/2011 Fraser et al.
8,118,106 B2 2/2012 Wiens et al.
8,141,642 B2 3/2012 Olstad et al.
8,210,268 B2 7/2012 Heidecke et al.
8,281,856 B2 10/2012 Jahn et al.
8,307,903 B2 11/2012 Redlinger et al.
8,365,834 B2 2/2013 Liess et al.
8,459,361 B2 6/2013 Leuchtenberg
8,505,984 B2 8/2013 Henderson et al.
8,567,512 B2 10/2013 Odell, II et al.
8,601,910 B2 12/2013 Begnaud
8,636,067 B2 1/2014 Robichaux et al.
8,651,175 B2 2/2014 Fallen
8,668,003 B2 3/2014 Osmundsen et al.
8,708,055 B2 4/2014 Liess et al.
8,727,021 B2 5/2014 Heidecke et al.
8,776,898 B2 7/2014 Liess et al.
8,783,339 B2 7/2014 Sinclair et al.
8,839,884 B2 9/2014 Kuttel et al.
8,893,772 B2 11/2014 Henderson et al.
9,068,406 B2 6/2015 Clasen et al.
9,206,851 B2 12/2015 Slaughter, Jr. et al.
9,631,438 B2 4/2017 McKay
2002/0043403 A1 4/2002 Juhasz et al.
2002/0074132 A1 6/2002 Juhasz et al.
2002/0084069 A1 7/2002 Mosing et al.
2002/0129934 A1 9/2002 Mullins et al.
2002/0170720 A1 11/2002 Haugen
2003/0098150 A1 5/2003 Andreychuk
2003/0107260 A1 6/2003 Ording et al.
2003/0221519 A1 12/2003 Haugen
2004/0003490 A1 1/2004 Shahin et al.
2004/0069497 A1 4/2004 Jones et al.
2004/0216924 A1 11/2004 Pietras et al.
2005/0000691 A1 1/2005 Giroux et al.
2005/0206163 A1 9/2005 Guesnon et al.
2005/0257933 A1 11/2005 Pietras
2005/0269072 A1 12/2005 Folk et al.
2005/0269104 A1 12/2005 Folk et al.
2005/0269105 A1 12/2005 Pietras
2005/0274508 A1* 12/2005 Folk ..... E21B 19/02 166/77.52
2006/0037784 A1 2/2006 Walter et al.
2006/0124353 A1 6/2006 Juhasz et al.
2006/0151181 A1 7/2006 Shahin
2006/0180315 A1 8/2006 Shahin et al.
2007/0044973 A1 3/2007 Fraser et al.
2007/0074874 A1 4/2007 Richardson
2007/0102992 A1 5/2007 Jager
2007/0131416 A1 6/2007 Odell, II et al.
2007/0140801 A1 6/2007 Kuttel et al.
2007/0144730 A1 6/2007 Shahin et al.
2007/0158076 A1 7/2007 Hollingsworth, Jr. et al.
2007/0251699 A1 11/2007 Neils et al.
2007/0251701 A1 11/2007 Jahn et al.
2007/0257811 A1 11/2007 Hall et al.
2008/0059073 A1 3/2008 Giroux et al.
2008/0099196 A1 5/2008 Latiolais et al.
2008/0125876 A1 5/2008 Boutwell
2008/0202812 A1* 8/2008 Childers ..... E21B 19/155 175/52
2008/0308281 A1 12/2008 Boutwell, Jr. et al.
2009/0151934 A1 6/2009 Heidecke et al.
2009/0159294 A1 6/2009 Abdollahi et al.
2009/0200038 A1 8/2009 Swietlik et al.
2009/0205820 A1 8/2009 Koederitz et al.
2009/0205827 A1 8/2009 Swietlik et al.
2009/0205836 A1 8/2009 Swietlik et al.
2009/0205837 A1 8/2009 Swietlik et al.
2009/0229837 A1 9/2009 Wiens et al.
2009/0266532 A1 10/2009 Revheim et al.
2009/0272537 A1 11/2009 Alikin et al.
2009/0274544 A1 11/2009 Liess
2009/0274545 A1 11/2009 Liess et al.
2009/0316528 A1 12/2009 Ramshaw et al.
2009/0321086 A1 12/2009 Zimmermann
2010/0032162 A1 2/2010 Olstad et al.
2010/0101805 A1 4/2010 Angelle et al.
2010/0200222 A1 8/2010 Robichaux et al.
2010/0206583 A1 8/2010 Swietlik et al.
2010/0206584 A1 8/2010 Clubb et al.
2010/0236777 A1 9/2010 Partouche et al.
2011/0036586 A1 2/2011 Hart et al.
2011/0039086 A1 2/2011 Graham et al.
2011/0214919 A1 9/2011 McClung, III
2011/0280104 A1 11/2011 McClung, III
2012/0048574 A1* 3/2012 Wiens ..... E21B 21/00 166/387
2012/0152530 A1 6/2012 Wiedecke et al.
2012/0160517 A1 6/2012 Bouligny et al.
2012/0212326 A1 8/2012 Christiansen et al.
2012/0234107 A1 9/2012 Pindiprolu et al.
2013/0055858 A1 3/2013 Richardson
2013/0056977 A1 3/2013 Henderson et al.
2013/0062074 A1 3/2013 Angelle et al.
2013/0075077 A1 3/2013 Henderson et al.
2013/0075106 A1 3/2013 Tran et al.
2013/0105178 A1 5/2013 Pietras
2013/0207382 A1 8/2013 Robichaux
2013/0207388 A1 8/2013 Jansson et al.

(56) References Cited

U.S. PATENT DOCUMENTS

| | | | |
|---|---|---|---|
| 2013/0233624 | A1 | 9/2013 | In |
| 2013/0269926 | A1 | 10/2013 | Liess et al. |
| 2013/0271576 | A1 | 10/2013 | Elllis |
| 2013/0275100 | A1 | 10/2013 | Ellis et al. |
| 2013/0299247 | A1 | 11/2013 | Küttel et al. |
| 2014/0090856 | A1 | 4/2014 | Pratt et al. |
| 2014/0116686 | A1 | 5/2014 | Odell, II et al. |
| 2014/0131052 | A1 | 5/2014 | Richardson |
| 2014/0202767 | A1 | 7/2014 | Feasey |
| 2014/0233804 | A1 | 8/2014 | Gustavsson et al. |
| 2014/0262521 | A1 | 9/2014 | Bradley et al. |
| 2014/0305662 | A1 | 10/2014 | Giroux et al. |
| 2014/0326468 | A1 | 11/2014 | Heidecke et al. |
| 2014/0352944 | A1 | 12/2014 | Devarajan et al. |
| 2014/0360780 | A1 | 12/2014 | Moss et al. |
| 2015/0014063 | A1 | 1/2015 | Simanjuntak et al. |
| 2015/0053424 | A1 | 2/2015 | Wiens et al. |
| 2015/0083391 | A1 | 3/2015 | Bangert et al. |
| 2015/0107385 | A1 | 4/2015 | Mullins et al. |
| 2015/0337648 | A1 | 11/2015 | Zippel et al. |
| 2016/0024862 | A1 | 1/2016 | Wilson et al. |
| 2016/0138348 | A1 | 5/2016 | Kunec |
| 2016/0145954 | A1 | 5/2016 | Helms et al. |
| 2016/0177639 | A1 | 6/2016 | McIntosh et al. |
| 2016/0215592 | A1 | 7/2016 | Helms et al. |
| 2016/0230481 | A1 | 8/2016 | Misson et al. |
| 2017/0044854 | A1 | 2/2017 | Hebebrand et al. |
| 2017/0044875 | A1 | 2/2017 | Hebebrand et al. |
| 2017/0051568 | A1 | 2/2017 | Wern et al. |
| 2017/0067303 | A1 | 3/2017 | Thiemann et al. |
| 2017/0067320 | A1 | 3/2017 | Zouhair et al. |
| 2017/0074075 | A1 | 3/2017 | Liess |
| 2017/0211343 | A1 | 7/2017 | Thiemann |
| 2017/0284164 | A1* | 10/2017 | Holmes ..... E21B 33/0355 |

FOREIGN PATENT DOCUMENTS

| | | | |
|---|---|---|---|
| AU | 2013205714 | A1 | 5/2013 |
| AU | 2014215938 | A1 | 9/2014 |
| CA | 2 707 050 | A1 | 6/2009 |
| CA | 2 841 654 | A1 | 8/2015 |
| CA | 2 944 327 | A1 | 10/2015 |
| DE | 102007016822 | A1 | 10/2008 |
| EP | 0 250 072 | A2 | 12/1987 |
| EP | 1 619 349 | A2 | 1/2006 |
| EP | 1 772 715 | A2 | 4/2007 |
| EP | 1961912 | A1 | 8/2008 |
| EP | 1961913 | A1 | 8/2008 |
| EP | 2085566 | A2 | 8/2009 |
| EP | 2 322 357 | A1 | 5/2011 |
| EP | 3032025 | A1 | 6/2016 |
| GB | 2 077 812 | A | 12/1981 |
| GB | 2 180 027 | A | 3/1987 |
| GB | 2 228 025 | A | 8/1990 |
| GB | 2 314 391 | A | 12/1997 |
| WO | 2004/079153 | A2 | 9/2004 |
| WO | 2004/101417 | A2 | 11/2004 |
| WO | 2007/001887 | A2 | 1/2007 |
| WO | 2007/070805 | A2 | 6/2007 |
| WO | 2007127737 | A2 | 11/2007 |
| WO | 2008005767 | A1 | 1/2008 |
| WO | 2009/076648 | A2 | 6/2009 |
| WO | 2012100019 | A1 | 7/2012 |
| WO | 2012/115717 | A2 | 8/2012 |
| WO | 2014056092 | A1 | 4/2014 |
| WO | 2015/000023 | A1 | 1/2015 |
| WO | 2015/119509 | A1 | 8/2015 |
| WO | 2015/127433 | A1 | 8/2015 |
| WO | 2016197255 | A1 | 12/2016 |
| WO | 2017/044384 | A1 | 3/2017 |

OTHER PUBLICATIONS

A123 Systems, 14Ah Prismatic Pouch Cell, Product Specification, www.a123systems.com.

Eaton Low Speed High Torque Motors E-MOLO-MC001-E6 Brochure, Sep. 2011.

Warrior, 250E Electric Top Drive (250-TON), 250H Hydraulic Top Drive (250-TON), Brochure, Apr. 2014, Rev. 1, www.warriorrig.com.

Warrior, 500E Electric Top Drive (500 ton—1000hp), Brochure, Document No. EC 009, May 2015, Rev. 3, www.warriorrig.com.

Weatherford, TorkSub™ Stand-Alone Torque Measuring System, Product Specification, Document No. 11368.00, Copyright 2011-2014, www.weatherford.com.

PCT International Search Report and Written Opinion dated Nov. 25, 2016, for International Patent Application No. PCT/US2016/050542.

Streicher Load/Torque Cell Systems; date unknown; 1 page.

3PS, Inc.; Enhanced Torque and Tension Sub with Integrated Turns; date unknown; 2 total pages.

Lefevre, et al.; Drilling Technology; Deeper, more deviated wells push development of smart drill stem rotary shouldered connections; dated 2008; 2 total pages.

PCT Invitaiton to Pay Additional Fees for International Application No. PCT/US2008/086699; dated Sep. 9, 2009; 7 total pages.

PCT Notification of Transmittal of the International Search Report and the Written Opinion of the International Searching Authority for International Application No. PCT/US2008/086699; dated Sep. 11, 2009; 19 total pages.

National Oilwell Varco; Rotary Shoulder Handbook; dated 2010; 116 total pages.

Australian Examination Report for Application No. 2008334992; dated Apr. 5, 2011; 2 total pages.

European Search Report for Application No. 08 860 261.0-2315; dated Apr. 12, 2011; 4 total pages.

European Extended Search Report for Application No. 12153779.9-2315; dated Apr. 5, 2012; 4 total pages.

Australian Examination Report for Application No. 2012201644; dated May 15, 2013; 3 total pages.

Canadian Office Action for Application No. 2,837,581; dated Aug. 24, 2015; 3 total pages.

European Extended Search Report for Application No. 15166062.8-1610; dated Nov. 23, 2015; 6 total pages.

Australian Examination Report for Application No. 2014215938; dated Feb. 4, 2016; 3 total pages.

Rexroth; Bosch Group; Motors and Gearboxes; Asynchronous high-speed motors 1 MB for high speeds; dated Apr. 13, 2016; 6 total pages.

Canadian Office Action for Application No. 2,837,581; dated Apr. 25, 2016; 3 total pages.

PCT Notification of Transmittal of the International Search Report and the Written Opinion of the International Searching Authority for International Application No. PCT/US2015/061960; dated Jul. 25, 2016; 16 total pages.

PCT Notification of Transmittal of the International Search Report and the Written Opinion of the International Searching Authority for International Application No. PCT/US2016/049462; dated Nov. 22, 2016; 14 total pages.

PCT Notification of Transmittal of the International Search Report and the Written Opinion of the International Searching Authority for International Application No. PCT/US2016/046458; dated Dec. 14, 2016; 16 total pages.

PCT Notification of Transmittal of the International Search Report and the Written Opinion of the International Searching Authority for International Application No. PCT/US2016/047813; dated Jan. 12, 2017; 15 total pages.

PCT Notification of Transmittal of the International Search Report and the Written Opinion of the International Searching Authority for International Application No. PCT/US2016/050139; dated Feb. 20, 2017; 20 total pages.

PCT Notification of Transmittal of the International Search Report and the Written Opinion of the International Searching Authority for International Application No. PCT/US2017/014646; dated Apr. 4, 2017; 14 total pages.

(56) References Cited

OTHER PUBLICATIONS

PCT Notification of Transmittal of the International Search Report and the Written Opinion of the International Searching Authority for International Application No. PCT/US2017/014224; dated Jun. 8, 2017; 15 total pages.
European Extended Search Report for Application No. 17152458.0-1609; dated Jun. 8, 2017; 7 total pages.
Australian Examination Report for Application No. 2017200371; dated Sep. 19, 2017; 5 total pages.
European Extended Search Report for Application No. 17195552.9-1614; dated Dec. 4, 2017; 6 total pages.
Australian Examination Report for Application No. 2017200371; dated Feb. 8, 2018; 6 total pages.
Canadian Office Action for Application No. 2,955,754; dated Mar. 28, 2018; 3 total pages.
Australian Examination Report for Application No. 2017200371; dated May 2, 2018; 4 total pages.
Canadian Office Action for Application No. 2,974,298; dated May 16, 2018; 3 total pages.
European Patent Office; Extended European Search Report for Application No. 18157915.2; dated Jun. 6, 2018; 8 total pages.
Canadian Office Action in related application CA 2,955,754 dated Jul. 17, 2018.
EPO Partial European Search Report dated Jul. 31, 2018, for European Application No. 18159597.6.
EPO Partial European Search Report dated Oct. 4, 2018, for European Patent Application No. 18159598.4.
EPO Extended European Search Report dated Oct. 5, 2018, for European Patent Application No. 18173275.1.
EPO Extended European Search Report dated Nov. 6, 2018, for European Application No. 18159597.6.
International Search Report and Written Opinion in PCT/US2018/042812 dated Oct. 17, 2018.
Extended Search Report in application EP18177312.8 dated Nov. 6, 2018.

* cited by examiner

GENSET FOR TOP DRIVE UNIT

BACKGROUND OF THE DISCLOSURE

Field of the Disclosure

The present disclosure generally relates to a genset for a top drive unit.

Description of the Related Art

A wellbore is formed to access hydrocarbon-bearing formations (e.g., crude oil and/or natural gas) or for geothermal power generation by the use of drilling. Drilling is accomplished by utilizing a drill bit that is mounted on the end of a drill string. To drill within the wellbore to a predetermined depth, the drill string is often rotated by a top drive on a surface rig. After drilling to a predetermined depth, the drill string and drill bit are removed and a section of casing is lowered into the wellbore. An annulus is thus formed between the string of casing and the formation. The casing string is hung from the wellhead. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Top drives are equipped with a motor for rotating the drill string. The quill of the top drive is typically threaded for connection to an upper end of the drill pipe in order to transmit torque to the drill string. The top drive may also have various accessories to facilitate drilling. For adapting to the larger casing string, the drilling accessories are removed from the top drive and a casing running tool is added to the top drive. The casing running tool has a threaded adapter for connection to the quill and grippers for engaging an upper end of the casing string. It would be useful to have sensors on the casing running tool to monitor operation thereof. Transmitting electricity from a stationary power source to the rotating casing running tool is problematic. Electrical slip rings are not practical because the top drive operates in a harsh environment where components are exposed to shock and vibration. Moreover, because slip rings can spark during operation, they require complex measures, such as flameproof housings or purging with air for use in the explosive atmospheres that sometime occur during casing running operations. Slip rings also utilize brushes requiring frequent replacement. It would be beneficial to provide a local source of electrical power for the various accessories that facilitate drilling.

SUMMARY OF THE DISCLOSURE

The present disclosure generally relates to a genset for a top drive unit. In one embodiment, a system includes an accessory tool selected from a group consisting of a casing unit, a cementing unit, and a drilling unit; and a genset mounted to the accessory tool and comprising: a fluid driven motor having an inlet and an outlet for connection to a control swivel of the system; an electric generator connected to the fluid driven motor; a manifold having an inlet for connection to the control swivel and an outlet connected an accessory tool actuator; and a control unit in communication with the electric generator and the manifold and comprising a wireless data link.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
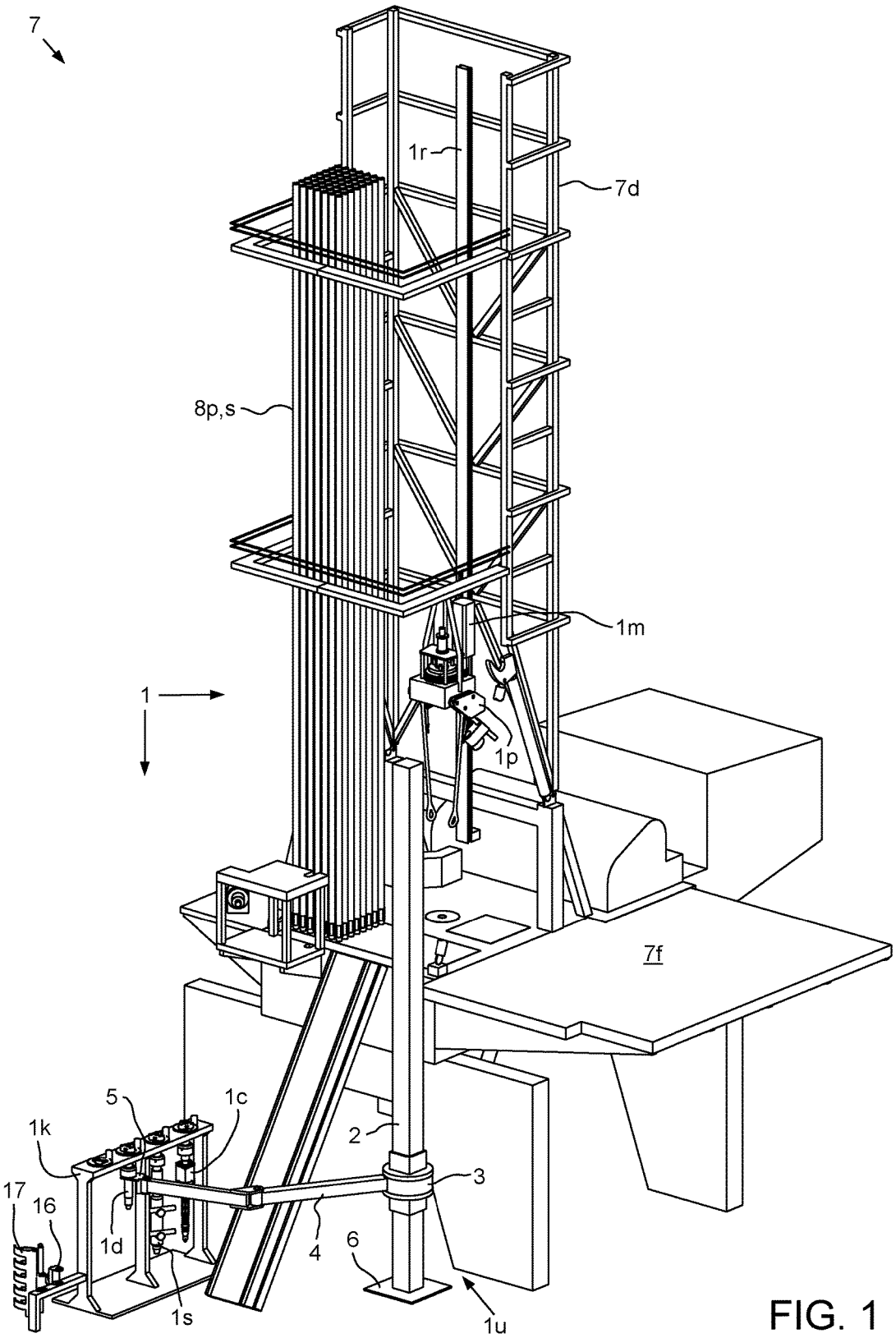
FIG. 1 illustrates a top drive system, according to one embodiment of the present disclosure.

FIG. 1 illustrates a top drive system 1, according to one embodiment of the present disclosure. The top drive system 1 may be a modular top drive system and may include a linear actuator 1*a* (FIG. 8A), several accessory tools (e.g., casing unit 1*c*, a drilling unit 1*d*, and a cementing unit 1*s*) a pipe handler 1*p*, a unit rack 1*k*, a motor unit 1*m*, a rail 1*r*, and a unit handler 1*u*. The unit handler 1*u* may include a post 2, a slide hinge 3, an arm 4, a holder 5, a base 6, and one or more actuators (not shown). One or more of the accessory tools may include a genset 51 (sometimes referred to as an engine-generator set, and typically including an electric generator and an engine or motor mounted together to form a single piece of equipment).

The top drive system 1 may be assembled as part of a drilling rig 7 by connecting a lower end of the rail 1*r* to a floor 7*f* or derrick 7*d* of the rig and an upper end of the rail to the derrick 7*d* such that a front of the rail is adjacent to a drill string opening in the rig floor. The rail 1*r* may have a length sufficient for the top drive system 1 to handle stands 8*s* of two to four joints of drill pipe 8*p*. The rail length may be greater than or equal to twenty-five meters and less than or equal to one hundred meters. The rail 1*r* may be a monorail (shown) or the top drive system may include twin rails instead of the monorail 1*r*.

The base 6 may mount the post 2 on or adjacent to a structure of the drilling rig 7, such as a subfloor structure, such as a catwalk (not shown) or pad. The unit rack 1*k* may also be located on or adjacent to the rig structure. The post 2 may extend vertically from the base 6 to a height above the rig floor 7*f* such that the unit handler 1*p* may retrieve any of the units 1*c,d,s* from the rack 1*k* and deliver the retrieved unit to the motor unit 1*m*.

The arm 4 may be connected to the slide hinge 3, such as by fastening. The slide hinge 3 may be transversely connected to the post 2, such as by a slide joint, while being free to move longitudinally along the post. The slide hinge 3 may also be pivotally connected to a linear actuator (not shown), such as by fastening. The slide hinge 3 may longitudinally support the arm 4 from the linear actuator while allowing pivoting of the arm relative to the post 2. The unit handler 1*u* may further include an electric or hydraulic slew motor (not shown) for pivoting the arm 4 about the slide hinge 3.

The linear actuator may have a lower end pivotally connected to the base 6 and an upper end pivotally connected to the slide hinge 3. The linear actuator may include a cylinder and a piston disposed in a bore of the cylinder. The piston may divide the cylinder bore into a raising chamber and a lowering chamber and the cylinder may have ports formed through a wall thereof and each port may be in fluid communication with a respective chamber. Each port may be in fluid communication with a manifold 60*m* of a hydraulic power unit (HPU) 60 (both in FIG. 5) via a control line (not shown). Supply of hydraulic fluid to the raising port may move the slide hinge 3 and arm 4 upward to the rig floor 7*f*. Supply of hydraulic fluid to the lowering port may move the slide hinge 3 and arm 4 downward toward the base 6.

Alternatively, the linear actuator may include an electromechanical linear actuator, such as a motor and lead screw or pinion and gear rod, instead of the piston and cylinder assembly.

The arm 4 may include a forearm segment, an aft-arm segment, and an actuated joint, such as an elbow, connecting the arm segments. The holder 5 may be releasably connected to the forearm segment, such as by fastening. The arm 4 may further include an actuator (not shown) for selectively curling and extending the forearm segment and relative to the aft-arm segment. The arm actuator may have an end pivotally connected to the forearm segment and another end pivotally connected to the aft-arm segment. The arm actuator may include a cylinder and a piston disposed in a bore of the cylinder. The piston may divide the cylinder bore into an extension chamber and a curling chamber and the cylinder may have ports formed through a wall thereof and each port may be in fluid communication with a respective chamber. Each port may be in fluid communication with the HPU manifold 60*m* via a control line (not shown). Supply of hydraulic fluid to the respective ports may articulate the forearm segment and holder 5 relative to the aft-arm segment toward the respective positions.

Alternatively, the arm actuator may include an electromechanical linear actuator, such as a motor and lead screw or pinion and gear rod, instead of the piston and cylinder assembly. Alternatively, the actuated joint may be a telescopic joint instead of an elbow. Additionally, the holder 5 may include a safety latch for retaining any of the units 1*c,d,s* thereto after engagement of the holder therewith to prevent unintentional release of the units during handling thereof. Additionally, the holder 5 may include a brake for torsionally connecting any of the units 1*c,d,s* thereto after engagement of the holder therewith to facilitate connection to the motor unit 1*m*.

Figure 8A:
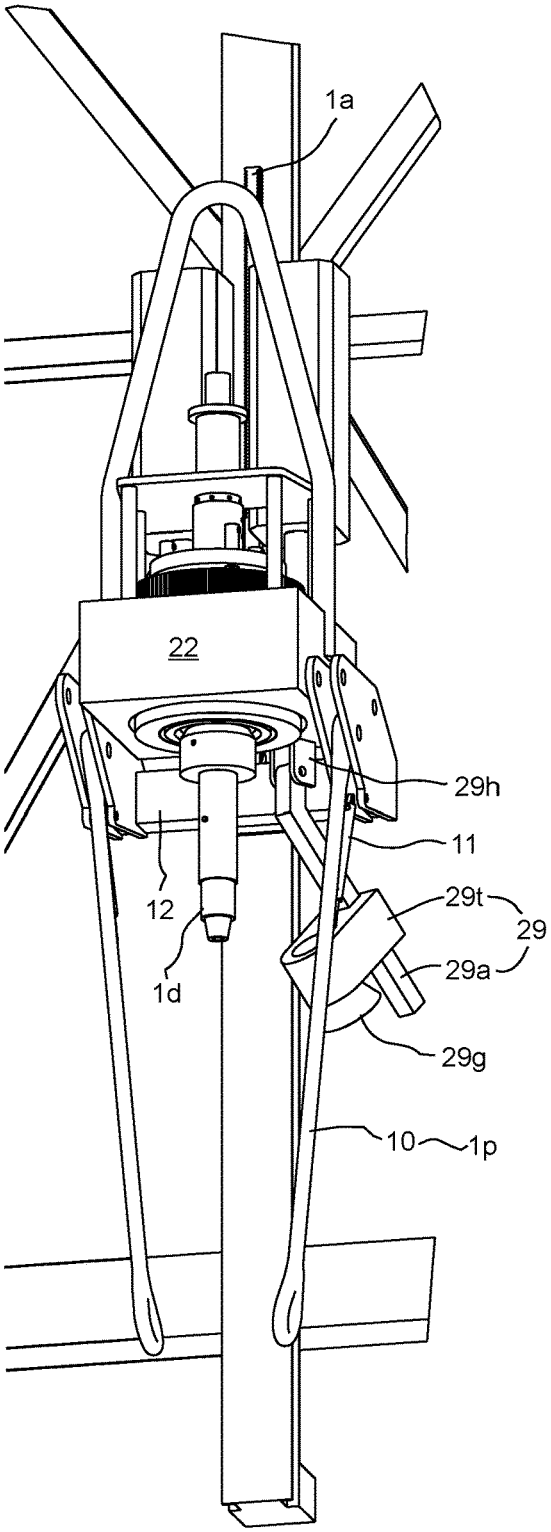
Figure 8B:
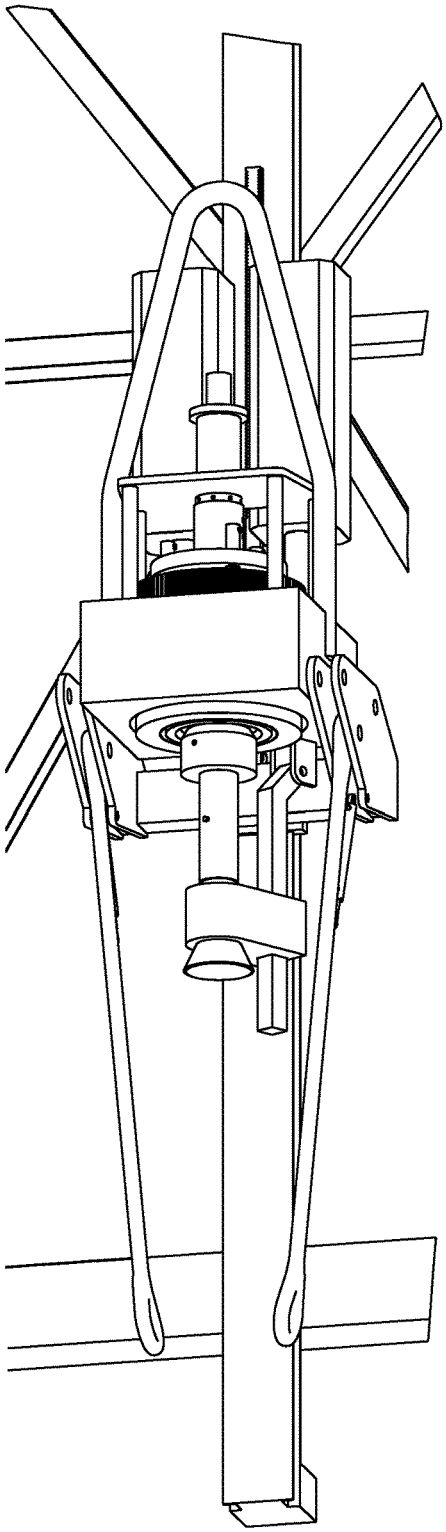

Referring to FIG. 8A, the pipe handler 1*p* may include a drill pipe elevator 9 (FIG. 9), a pair of bails 10, a link tilt 11, and a slide hinge 12. The slide hinge 12 may be transversely connected to the front of the rail 1*r* such as by a slide joint, while being free to move longitudinally along the rail. Each bail 10 may have an eyelet formed at each longitudinal end thereof. An upper eyelet of each bail 10 may be received by a respective pair of knuckles of the slide hinge 12 and pivotally connected thereto, such as by fastening. Each bail 10 may be received by a respective ear of the drill pipe elevator 9*d* and pivotally connected thereto, such as by fastening.

Figure 5:
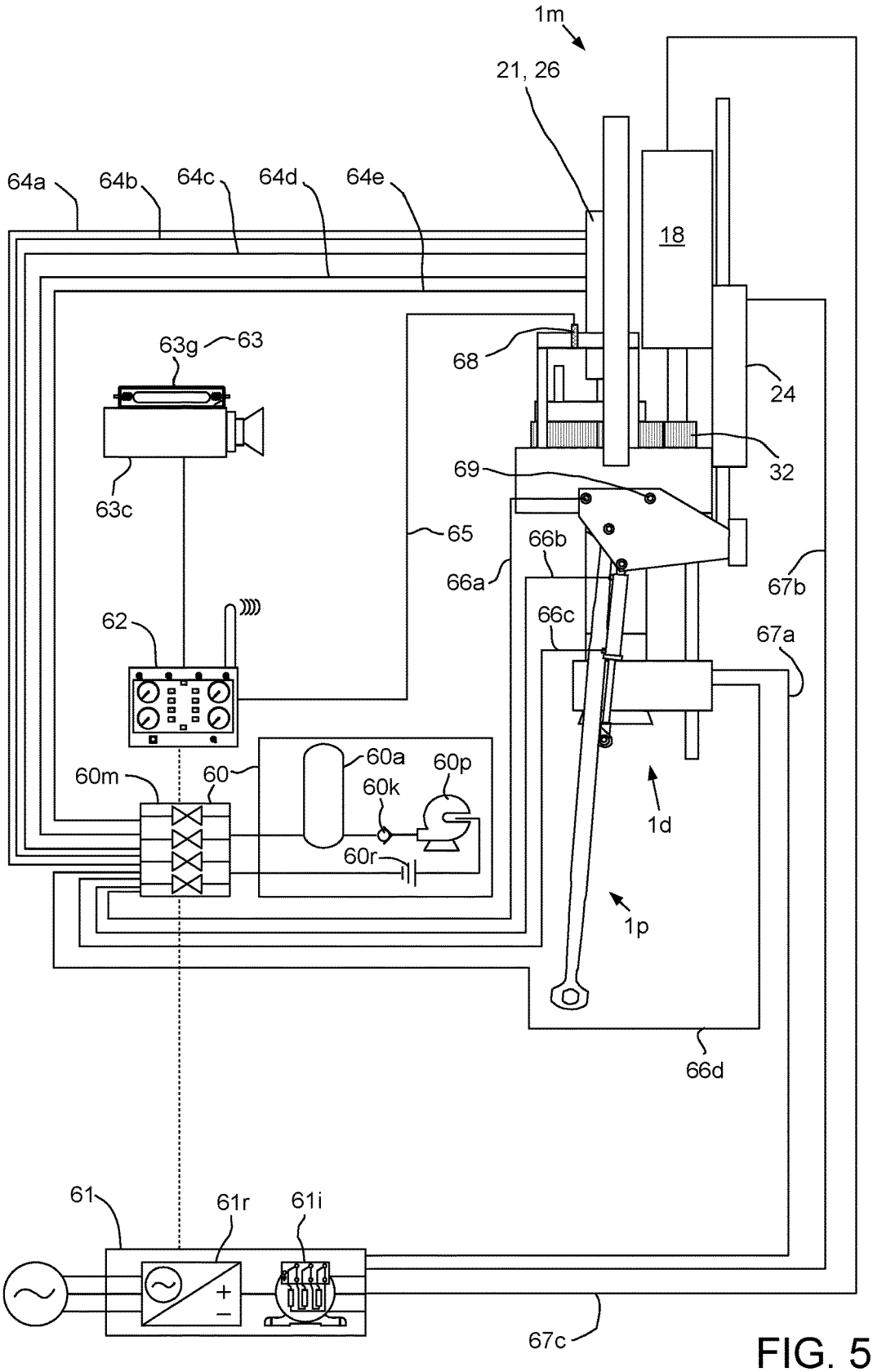
FIG. 5 is a control diagram of the top drive system in a drilling mode.
Figure 6:
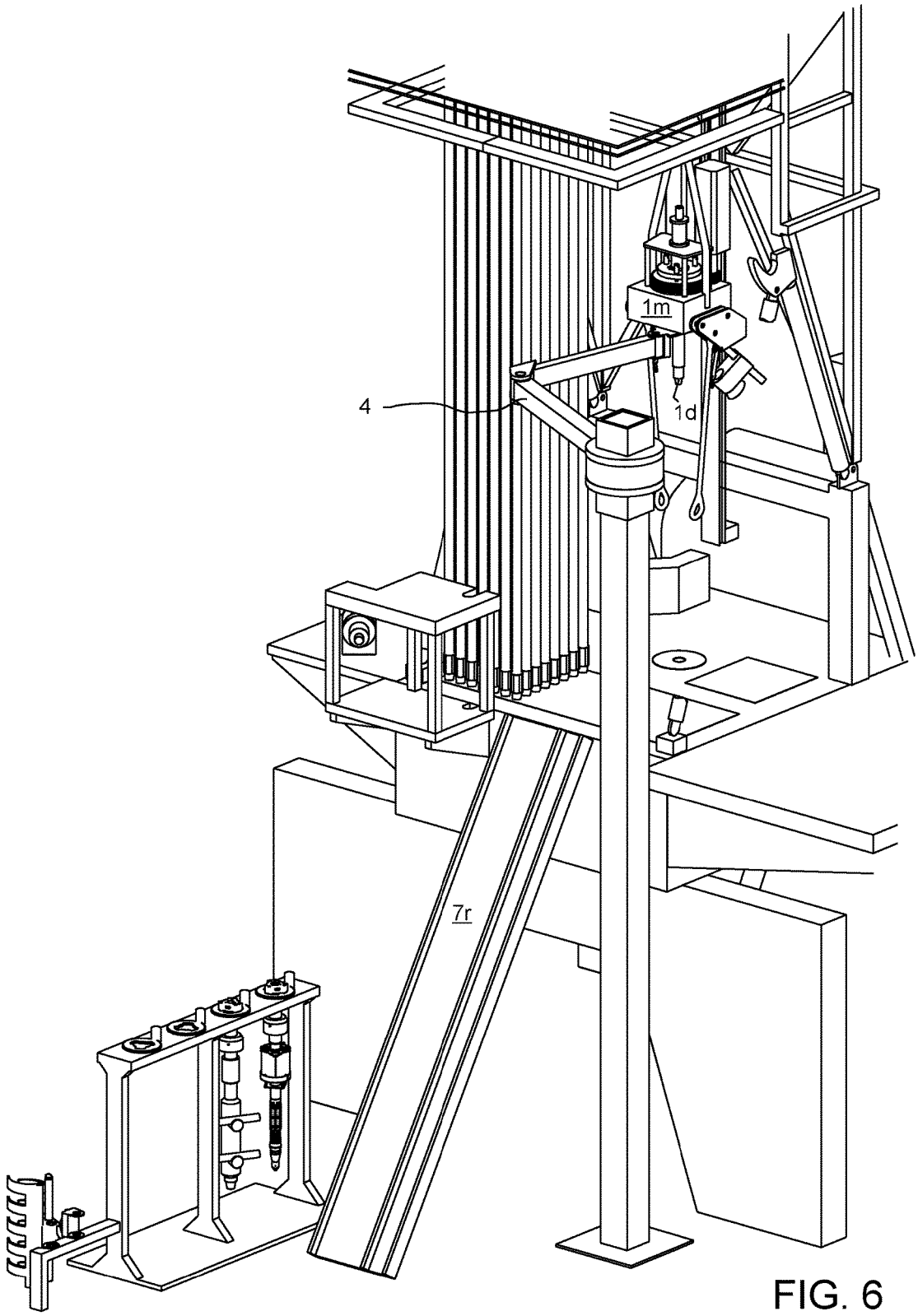
FIGS. 6, 7A, 7B, 8A, and 8B illustrate shifting of the top drive to the drilling mode.

The link tilt 11 may include a pair of piston and cylinder assemblies for swinging the elevator 9 relative to the slide hinge 12. Each piston and cylinder assembly may have a coupling, such as a hinge knuckle, formed at each longitudinal end thereof. An upper hinge knuckle of each piston and cylinder assembly may be received by the respective lifting lug of the slide hinge 12 and pivotally connected thereto, such as by fastening. A lower hinge knuckle of each piston and cylinder assembly may be received by a complementary hinge knuckle of the respective bail 10 and pivotally connected thereto, such as by fastening. A piston of each piston and cylinder assembly may be disposed in a bore of the respective cylinder. The piston may divide the cylinder bore into a raising chamber and a lowering chamber and the cylinder may have ports formed through a wall thereof and each port may be in fluid communication with a respective chamber. Each port may be in fluid communication with the HPU manifold 60*m* via a respective control line 66*b,c* (FIG. 5). Supply of hydraulic fluid to the raising port may lift the elevator 9 by increasing a tilt angle (measured from a longitudinal axis of the rail 1*r*). Supply of hydraulic fluid to the lowering port may drop the elevator 9 by decreasing the tilt angle.

The drill pipe elevator 9 may be manually opened and closed or the pipe handler 1*p* may include an actuator (not shown) for opening and closing the elevator. The drill pipe elevator 9 may include a bushing having a profile, such as a bottleneck, complementary to an upset formed in an outer surface of a joint of the drill pipe 8*p* adjacent to the threaded coupling thereof. The bushing may receive the drill pipe 8*p* for hoisting one or more joints thereof, such as the stand 8*s*. The bushing may allow rotation of the stand 8*s* relative to the pipe handler 1*p*. The pipe handler 1*p* may deliver the stand 8*s* to a drill string 8 where the stand 8*s* may be assembled therewith to extend the drill string during a drilling operation. When connected to the motor unit 1*m*, the pipe handler 1*p* may be capable of supporting the weight of the drill string 8 to expedite tripping of the drill string.

The linear actuator 1*a* may raise and lower the pipe handler 1*p* relative to the motor unit 1*m* and may include a gear rack, one or two pinions (not shown), and one or two pinion motors (not shown). The gear rack may be a bar having a geared upper portion and a plain lower portion. The gear rack may have a knuckle formed at a bottom thereof for pivotal connection with a lifting lug of the slide hinge 12, such as by fastening. Each pinion may be meshed with the geared upper portion and torsionally connected to a rotor of the respective pinion motor. A stator of each pinion motor may be connected to the motor unit 1*m* and be in electrical communication with a motor driver 61 via a cable 67*b* (both shown in FIG. 5). The pinion motors may share a cable via a splice (not shown). Each pinion motor may be reversible and rotation of the respective pinion in a first direction, such as counterclockwise, may raise the slide hinge 12 relative to the motor unit 1*m* and rotation of the respective pinion in a second opposite direction, such as clockwise, may lower the slide hinge relative to the motor unit. Each pinion motor may include a brake (not shown) for locking position of the slide hinge once the pinion motors are shut off. The brake may be disengaged by supply of electricity to the pinion motors and engaged by shut off of electricity to the pinion motors.

The linear actuator 1*a* may be capable of hoisting the stand 8*s*. A stroke of the linear actuator 1*a* may be sufficient to stab a top coupling of the stand 8*s* into a quill 37 of the motor unit 1*m*.

The unit rack 1*k* may include a base, a beam, two or more (three shown) columns connecting the base to the beam, such as by welding or fastening, and a parking spot for each of the units 1*c,d,s* (four spots shown). A length of the columns may correspond to a length of the longest one of the units 1*c,d,s*, such as being slightly greater than the longest length. The columns may be spaced apart to form parking spots (four shown) between adjacent columns. The units 1*c,d,s* may be hung from the beam by engagement of the parking spots with respective couplings 15 (FIG. 2B) of the units. Each parking spot may include an opening formed through the beam, a ring gear, and a motor. Each ring gear may be supported from and transversely connected to the beam by a bearing (not shown) such that the ring gear may rotate relative to the beam. Each bearing may be capable supporting the weight of any of the units 1*c,d,s* and placement of a particular unit in a particular parking spot may be arbitrary.

Each motor may include a stator connected to the beam and may be in electrical communication with the motor driver 61 via a cable (not shown). A rotor of each motor may be meshed with the respective ring gear for rotation thereof between a disengaged position and an engaged position. Each ring gear may have an internal latch profile, such as a bayonet profile, and each coupling 15 may include a head 15*h* having an external latch profile, such as a bayonet profile. The bayonet profiles may each have one or more (three shown) prongs and prong-ways spaced around the respective ring gears and heads 15*h* at regular intervals. When the prongs of the respective bayonet profiles are aligned, the external prongs of the heads 15*h* may be engaged with the internal prongs of the respective ring gears, thereby supporting the units 1*c,d,s* from the beam. When the external prongs of the heads 15*h* are aligned with the internal prong-ways of the ring gears (and vice versa), the heads may be free to pass through the respective ring gears.

Alternatively, the latch profiles may each be threads or load shoulders instead of bayonets. Alternatively, the unit rack 1*k* and the motor unit 1*m* may each have slips, a cone, and a linear actuator for driving the slips along the cone (or vice versa) instead of the latch profiles.

Each coupling 15 may further include a neck 15*n* extending from the head 15*h* and having a reduced diameter relative to a maximum outer diameter of the head for extending through the respective beam opening and respective ring gear. Each coupling 15 may further include a lifting shoulder 15*s* connected to a lower end of the neck 15*n* and having an enlarged diameter relative to the reduced diameter of the neck and a torso 15*r* extending from the lifting shoulder 15*s* and having a reduced diameter relative to the enlarged diameter of the lifting shoulder. The torso 15*r* may have a length corresponding to a length of the holder 5 for receipt thereof and a bottom of the lifting shoulder 15*s* may seat on a top of the holder for transport from the unit rack 1*k* to the motor unit 1*m*.

The unit rack 1*k* may further include a side bar for holding one or more accessories for connection to the forearm segment instead of the holder 5, such as a cargo hook 16 and a pipe clamp 17. The side bar may also hold the holder 5 when the unit handler 1*u* is equipped with one of the accessories.

Figure 2A:
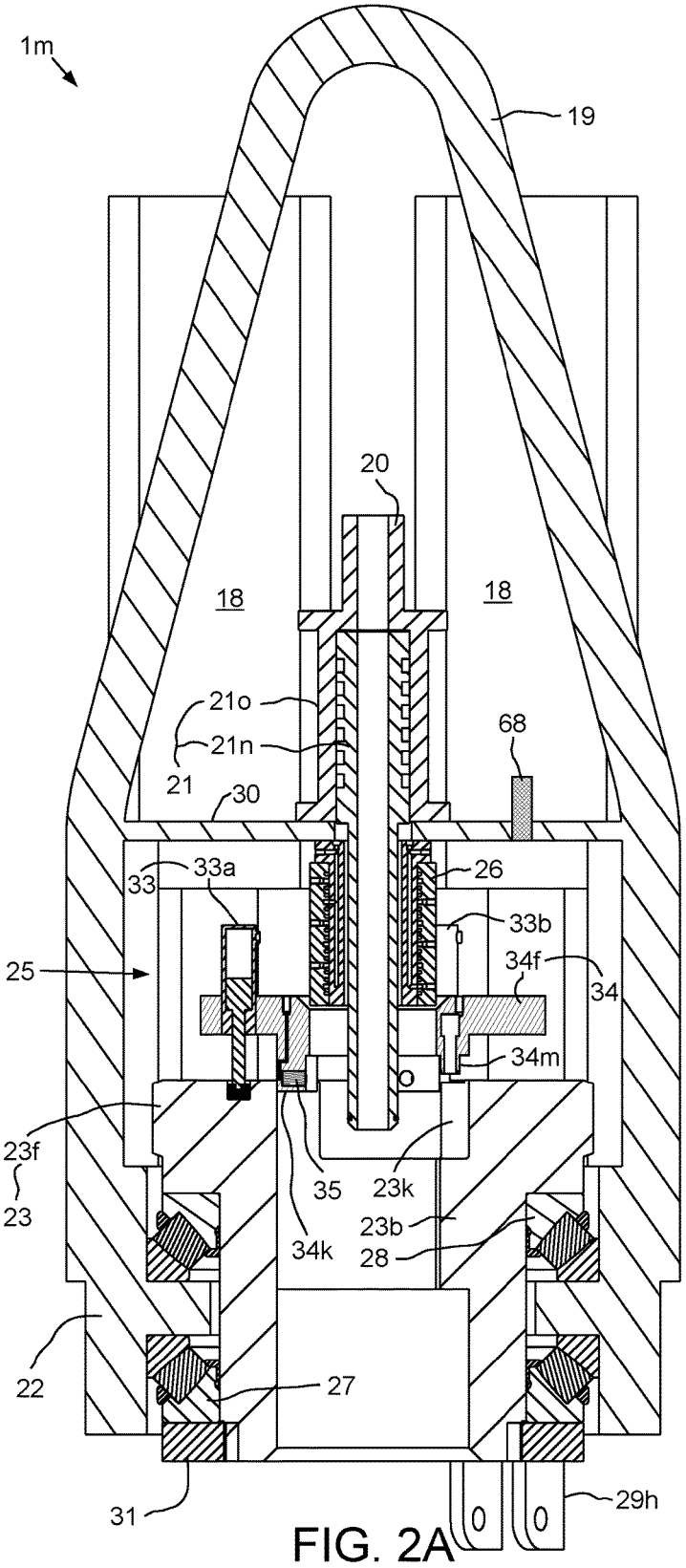
FIG. 2A illustrates a motor unit of the top drive system.
Figure 12A:
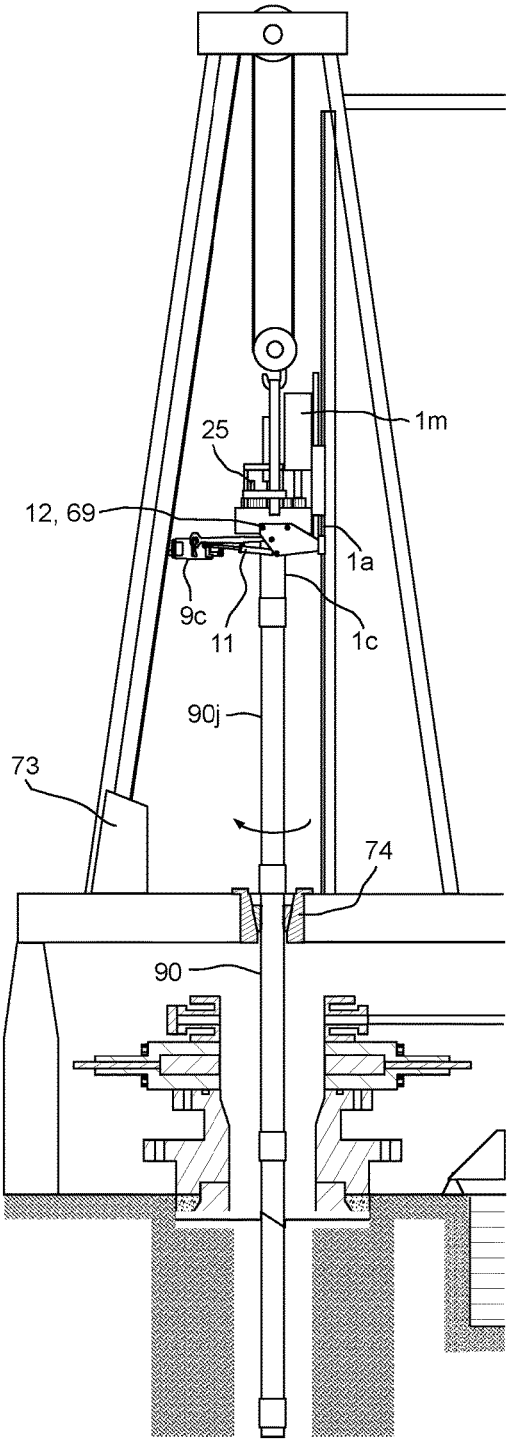

FIG. 2A illustrates the motor unit 1*m*. The motor unit 1*m* may include one or more (pair shown) drive motors 18, a becket 19, a hose nipple 20, a mud swivel 21, a drive body 22, a drive ring, such as drive gear 23, a trolley 24 (FIG. 5), a thread compensator 25, a control, such as hydraulic, swivel 26, a down thrust bearing 27, an up thrust bearing 28, a backup wrench 29 (FIG. 8A), a swivel frame 30, a bearing retainer 31, a motor gear 32 (FIG. 5), and a latch 69 (FIG. 5). The drive body 22 may be rectangular, may have thrust chambers formed therein, may have an inner rib dividing the thrust chambers, and may have a central opening formed therethrough and in fluid communication with the chambers. The drive gear 23 may be cylindrical, may have a bore therethrough, may have an outer flange 23*f* formed in an upper end thereof, may have an outer thread formed at a lower end thereof, may have an inner locking profile 23*k* formed at an upper end thereof, and may have an inner latch profile, such as a bayonet profile 23*b*, formed adjacently below the locking profile. The inner bayonet profile 23*b* may be similar to the inner bayonet profile of the ring gears except for having a substantially greater thickness for sustaining weight of either the drill string 8 or a casing string 90 (FIG. 12A). The bearing retainer 31 may have an inner thread engaged with the outer thread of the drive gear 23, thereby connecting the two members.

The drive motors 18 may be electric (shown) or hydraulic (not shown) and have a rotor and a stator. A stator of each drive motor 18 may be connected to the trolley 24, such as by fastening, and be in electrical communication with the motor driver 61 via a cable 67*c* (FIG. 5). The motors 18 may be operable to rotate the rotor relative to the stator which may also torsionally drive respective motor gears 32. The motor gears 32 may be connected to the respective rotors and meshed with the drive gear 23 for torsional driving thereof.

Alternatively, the motor unit 1*m* may instead be a direct drive unit having the drive motor 18 centrally located.

Each thrust bearing 27, 28 may include a shaft washer, a housing washer, a cage, and a plurality of rollers extending through respective openings formed in the cage. The shaft washer of the down thrust bearing 27 may be connected to the drive gear 23 adjacent to a bottom of the flange thereof. The housing washer of the down thrust bearing 27 may be connected to the drive body 22 adjacent to a top of the rib thereof. The cage and rollers of the down thrust bearing 27 may be trapped between the washers thereof, thereby supporting rotation of the drive gear 23 relative to the drive body 22. The down thrust bearing 27 may be capable of sustaining weight of a tubular string, such as either the drill string 8 or the casing string 90, during rotation thereof. The shaft washer of the up thrust bearing 28 may be connected to the drive gear 23 adjacent to the bearing retainer 31. The housing washer of the up thrust bearing 28 may be connected to the drive body 22 adjacent to a bottom of the rib thereof. The cage and rollers of the up thrust bearing 28 may be trapped between the washers thereof.

The trolley 24 may be connected to a back of the drive body 22, such as by fastening. The trolley 24 may be transversely connected to a front of the rail 1*r* and may ride along the rail, thereby torsionally restraining the drive body 22 while allowing vertical movement of the motor unit 1*m* with a travelling block 73*t* (FIG. 9) of a rig hoist 73. The becket 19 may be connected to the drive body 22, such as by fastening, and the becket may receive a hook of the traveling block 73*t* to suspend the motor unit 1*m* from the derrick 7*d*.

Alternatively, motor unit 1*m* may include a block-becket instead of the becket 19 and the block-becket may obviate the need for a separate traveling block 73*t*.

The hose nipple 20 may be connected to the mud swivel 21 and receive an end of a mud hose (not shown). The mud hose may deliver drilling fluid 87 (FIG. 9) from a standpipe 79 (FIG. 9) to the hose nipple 20. The mud swivel 21 may have an outer non-rotating barrel 210 connected to the hose nipple 20 and an inner rotating barrel 21*n*. The mud swivel 21 may have a bearing (not shown) and a dynamic seal (not shown) for accommodating rotation of the rotating barrel relative to the non-rotating barrel. The outer non-rotating barrel 210 may be connected to a top of the swivel frame 30, such as by fastening. The swivel frame 30 may be connected to a top of the drive body 22, such as by fastening. The inner rotating barrel 21*n* may have an upper portion disposed in the outer non-rotating barrel 210 and a stinger portion extending therefrom, through the control swivel 26, and through the compensator 25. A lower end of the stinger portion may carry a stab seal for engagement with an inner seal receptacle 15*b* of each coupling 15 when the respective unit 1*c,d,s* is connected to the motor unit 1*m*, thereby sealing an interface formed between the units.

The control swivel 26 may include a non-rotating inner barrel and a rotating outer barrel. The inner barrel may be connected to the swivel frame 30 and the outer barrel may be supported from the inner barrel by one or more bearings. The outer barrel may have hydraulic ports (six shown) formed through a wall thereof, each port in fluid communication with a respective hydraulic passage formed through the inner barrel (only two passages shown). An interface between each port and passage may be straddled by dynamic seals for isolation thereof. The inner barrel passages may be in fluid communication with the HPU manifold 60*m* via a plurality of fluid connectors, such as the hydraulic conduits 64*a-e* (FIG. 5), and the outer barrel ports may be in fluid communication with either the linear actuator 33 or lock ring 34 via jumpers (not shown). The outer barrel ports may be disposed along the outer barrel. The inner barrel may have a mandrel portion extending along the outer barrel and a head portion extending above the outer barrel. The head portion may connect to the swivel frame 30 and have the hydraulic ports extending therearound.

Figure 7A:
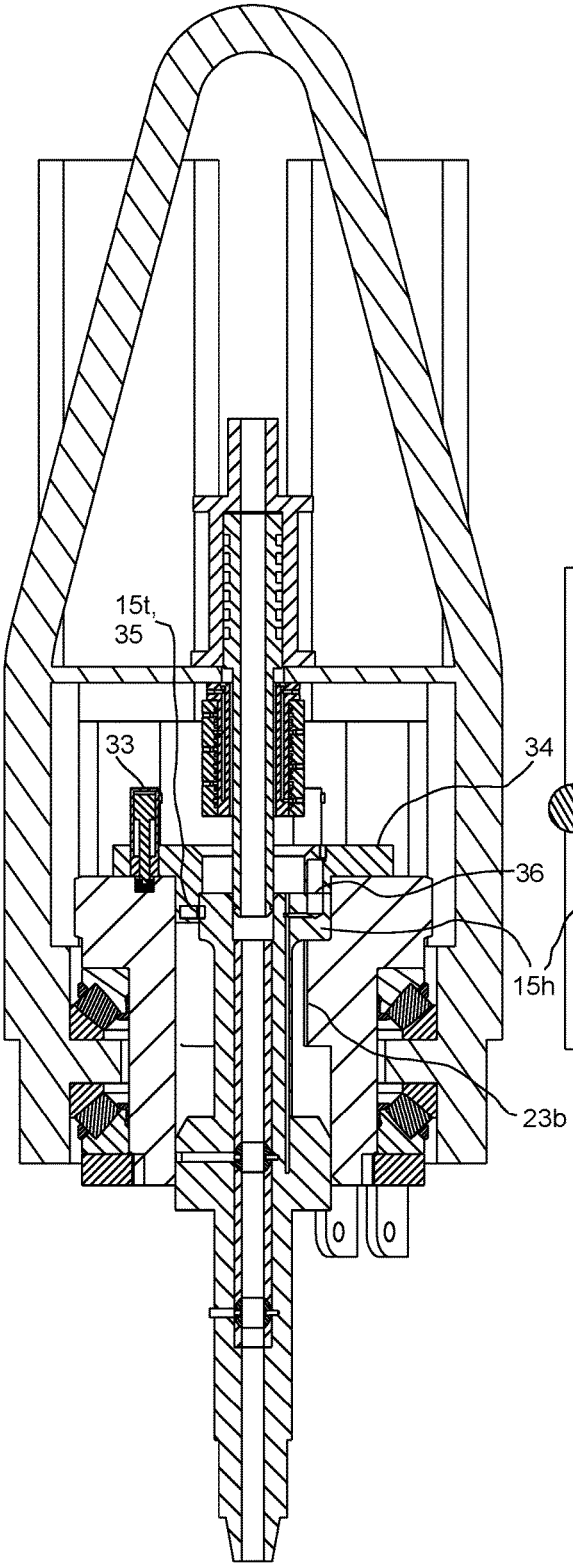
Figure 7B:
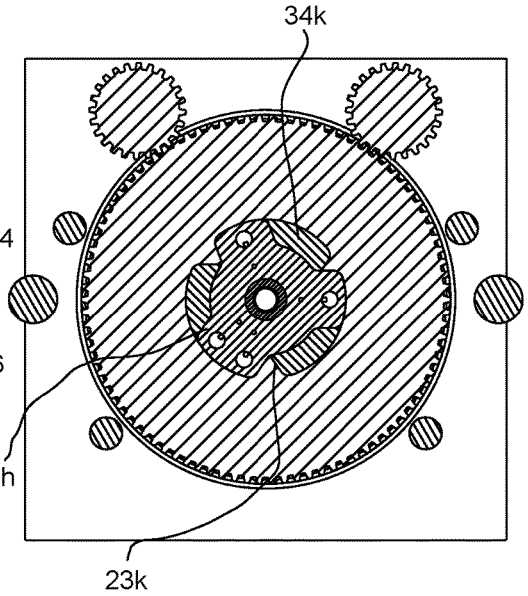

The compensator 25 may include a linear actuator 33, the lock ring 34, and one or more (such as three, but only one shown) lock pins 35. The lock ring 34 may have an outer flange 34*f* formed at an upper end thereof, a bore formed therethrough, one or more chambers housing the lock pins 35 formed in an inner surface thereof, a locking profile 34*k* formed in a lower end thereof, members, such as males 34*m*, of a hydraulic junction 36 (FIG. 7A) formed in the lower end thereof, and hydraulic passages (two shown) formed through a wall thereof. The locking profile 34*k* may include a lug for each prong-way of the external bayonet profiles of the heads 15*h*.

Each lock pin 35 may be a piston dividing the respective chamber into an extension portion and a retraction portion and the lock ring 34 may have passages formed through the wall thereof for the chamber portions. Each passage may be in fluid communication with the HPU manifold 60*m* via a respective fluid connector, such as hydraulic conduit 64*a* (FIG. 3, only one shown). The lock pins 35 may share an extension control line and a retraction control line via a splitter (not shown). Supply of hydraulic fluid to the extension passages may move the lock pins 35 to an engaged position where the pins extend into respective slots 15*t* formed in the prong-ways of the heads 15*h*, thereby longitudinally connecting the lock ring 34 to a respective unit 1*c,d,s*. Supply of hydraulic fluid to the retraction passages may move the lock pins 35 to a release position (shown) where the pins are contained in the respective chambers of the lock ring 34.

The linear actuator 33 may include one or more, such as three, piston and cylinder assemblies 33*a,b* for vertically moving the lock ring 34 relative to the drive gear 23 between a lower hoisting position (FIG. 7A) and an upper ready position (shown). A bottom of the lock ring flange 34*f* may be seated against a top of the drive gear flange 23*f* in the hoisting position such that string weight carried by either the drilling unit 1*d* or the casing unit 1*c* may be transferred to the drive gear 23 via the flanges and not the linear actuator 33 which may be only capable of supporting stand weight or weight of a casing joint 90*j* (FIG. 12A) of casing. String weight may be one hundred (or more) times that of stand weight or joint weight. A piston of each assembly 33*a,b* may be seated against the respective cylinder in the ready position.

Each cylinder of the linear actuator 33 may be disposed in a respective peripheral socket formed through the lock ring flange 34*f* and be connected to the lock ring 34, such as by threaded couplings. Each piston of the linear actuator 33 may extend into a respective indentation formed in a top of the drive gear flange 23*f* and be connected to the drive gear 23, such as by threaded couplings. Each socket of the lock ring flange 34*f* may be aligned with the respective lug of the locking profile 34*k* and each indentation of the drive gear flange 23*f* may be aligned with a receptacle of the locking profile 23*k* such that connection of the linear actuator 33 to the lock ring 34 and drive gear 23 ensures alignment of the locking profiles.

Each piston of the linear actuator 33 may be disposed in a bore of the respective cylinder. The piston may divide the cylinder bore into a raising chamber and a lowering chamber and the cylinder may have ports (only one shown) formed through a wall thereof and each port may be in fluid communication with a respective chamber. Each port may be in fluid communication with the HPU manifold 60*m* via a respective fluid connector, such as hydraulic conduit 64*b* (only one shown in FIG. 5). Supply of hydraulic fluid to the raising port may lift the lock ring 34 toward the ready position. Supply of hydraulic fluid to the lowering port may drop the lock ring 34 toward the hoisting position. A stroke length of the linear compensator 25 between the ready and hoisting positions may correspond to, such as being equal to or slightly greater than, a makeup length of the drill pipe 8*p* and/or casing joint 90*j*.

Each coupling 15 may further include mating members, such as females 15*f*, of the junction 36 formed in a top of the prongs of the head 15*h*. The male members 34*m* may each have a nipple for receiving a respective jumper from the control swivel 26, a stinger, and a passage connecting the nipple and the stinger. Each stinger may carry a respective seal. The female member 15*f* may have a seal receptacle for receiving the respective stinger. The junction members 34*m*, 15*f* may be asymmetrically arranged to ensure that the male member 34*m* is stabbed into the correct female member 15*f*.

Referring to FIG. 8A, the backup wrench 29 may include a hinge 29*h*, a tong 29*t*, a guide 29*g*, an arm 29*a*, a tong actuator (not shown), a tilt actuator (not shown), and a linear actuator (not shown). The tong 29*t* may be transversely connected to the arm 29*a* while being longitudinally movable relative thereto subject to engagement with a stop shoulder thereof. The hinge 29*h* may pivotally connect the arm 29*a* to a bottom of the drive body 22. The hinge 29*h* may include a pair of knuckles fastened or welded to the drive body 22 and a pin extending through the knuckles and a hole formed through a top of the arm 29*a*. The tilt actuator may include a piston and cylinder assembly having an upper end pivotally connected to the bottom of the drive body 22 and a lower end pivotally connected to a back of the arm 29*a*. The piston may divide the cylinder bore into an activation chamber and a stowing chamber and the cylinder may have ports (only one shown) formed through a wall thereof and each port may be in fluid communication with a respective chamber. Each port may be in fluid communication with the HPU manifold 60*m* via a respective control line (not shown). Supply of hydraulic fluid to the activation port may pivot the tong 29*t* about the hinge 29*h* toward the quill 37. Supply of hydraulic fluid to the stowing port may pivot the tong 29*t* about the hinge 29*h* away from the quill 37.

The tong 29*t* may include a housing having an opening formed therethrough and a pair of jaws (not shown) and the tong actuator may move one of the jaws radially toward or away from the other jaw. The guide 29*g* may be a cone connected to a lower end of the tong housing, such as by fastening, for receiving a threaded coupling, such as a box, of the drill pipe 8*p*. The quill 37 may extend into the tong opening for stabbing into the drill pipe box. Once stabbed, the tong actuator may be operated to engage the movable jaw with the drill pipe box, thereby torsionally connecting the drill pipe box to the drive body 22. The tong actuator may be hydraulic and operated by the HPU 60 via a control line 66*d* (FIG. 5).

The backup wrench linear actuator may include a gear rack (not shown) formed along a straight lower portion of the arm 29*a*, one or two pinions (not shown), and one or two pinion motors (not shown). The arm 29*a* may have a deviated upper portion engaged with the hinge 29*h*. Each pinion may be meshed with the gear rack of the arm 29*a* and torsionally connected to a rotor of the respective pinion motor. A stator of each pinion motor may be connected to the housing of the tong 29*t* and be in electrical communication with the motor driver 61 via a cable 67*a* (FIG. 5). The pinion motors may share a cable via a splice (not shown). Each pinion motor may be reversible and rotation of the respective pinion in a first direction, such as counterclockwise, may raise the tong 29*t* along the arm 29*a* and rotation of the respective pinion in a second opposite direction, such as clockwise, may lower the tong along the arm. Each pinion motor may include a brake (not shown) for locking position of the tong 29*t* once the pinion motors are shut off. The brake may be disengaged by supply of electricity to the pinion motors and engaged by shut off of electricity to the pinion motors.

Referring to FIG. 5, the latch 69 may include a one or more (pair shown) units disposed at sides of the drive body 22. Each latch unit may include a lug connected, such as by fastening or welding, to the drive body 22 and extending from a bottom thereof, a fastener, such as a pin, and an actuator. Each lug may have a hole formed therethrough and aligned with a respective actuator. Each interior knuckle of the slide hinge 12 may have a hole formed therethrough for receiving the respective latch pin. Each actuator may include a cylinder and piston (not shown) connected to the latch pin and disposed in a bore of the cylinder. Each cylinder may be connected to the drive body 22, such as by fastening, adjacent to the respective lug. The piston may divide the cylinder bore into an extension chamber and a retraction chamber and the cylinder may have ports formed through a wall thereof and each port may be in fluid communication with a respective chamber. Each port may be in fluid communication with the HPU manifold 60*m* via a control line 66*a* (FIG. 3, only one shown). The latch units may share an extension control line and a retraction control line via a splitter (not shown). Supply of hydraulic fluid to the extension port may move the pin to an engaged position (shown) where the pin extends through the respective lug hole and the respective interior knuckle hole of the slide hinge 12, thereby connecting the pipe handler 1*p* to the drive body 22. Supply of hydraulic fluid to the retraction port may move the pin to a release position (not shown) where the pin is clear of the interior slide hinge knuckle.

Figure 2B:
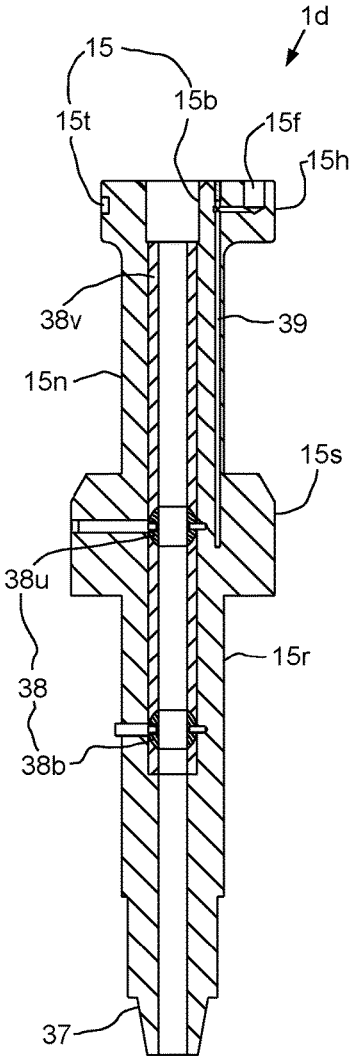
FIG. 2B illustrates a drilling unit of the top drive system.

FIG. 2B illustrates the drilling unit 1*d*. The drilling unit 1*d* may include the coupling, the quill 37, an internal blowout preventer (IBOP) 38, and one or more, such as two (only one shown), hydraulic passages 39. The quill 37 may be a shaft, may have an upper end connected to the torso 15*r*, may have a bore formed therethrough, may have a threaded coupling, such as a pin, formed at a lower end thereof. In some embodiments, the IBOP could be controlled from a separate control unit at the accessory tool. The separate control unit could be powered from the genset 51. For example, the genset 51 could be connected to the tool so as to avoid impacts during the drilling process, such as with springs.

The IBOP 38 may include an internal sleeve 38*v* and one or more shutoff valves 38*u,b*. The IBOP may further include an automated actuator for one 38*u* of the shutoff valves 38*u,b* and the other 38*b* of the shutoff valves 38*u,b* may be manually actuated. Each shutoff valve 38*u,b* may be connected to the sleeve 38*v* and the sleeve may be received in a recessed portion of the quill 37 and/or coupling 15. The IBOP valve actuator may be disposed in a socket formed through a wall of the quill 37 and/or coupling 15 and may include an opening port and/or a closing port and each port may be in fluid communication with the HPU manifold 60*m* via a respective hydraulic passage 39, respective male 34*m* and female 15*f* members, respective jumpers, the control swivel 26, and respective fluid connectors, such as hydraulic conduits 64*c,d* (FIG. 5). The hydraulic conduit 64*e* may connect to a drain port of the IBOP valve actuator.

Figure 3A:
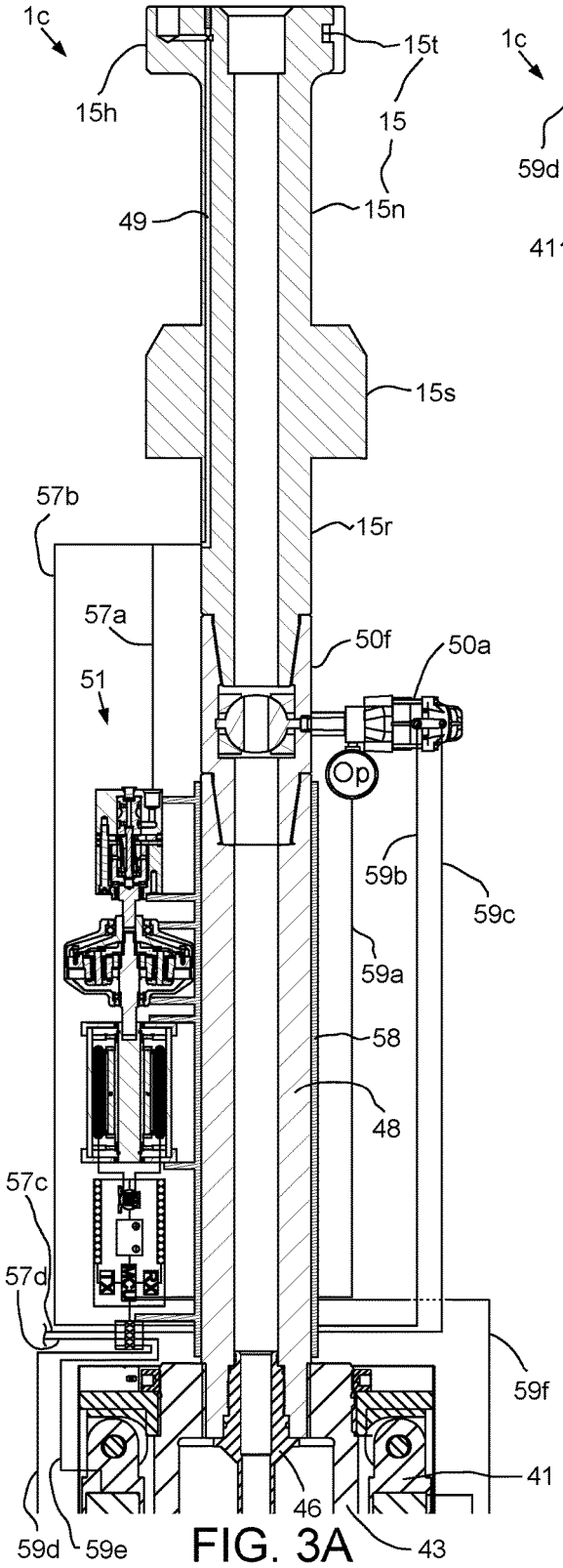
FIGS. 3A and 3B illustrate a casing unit of the top drive system.
Figure 3B:
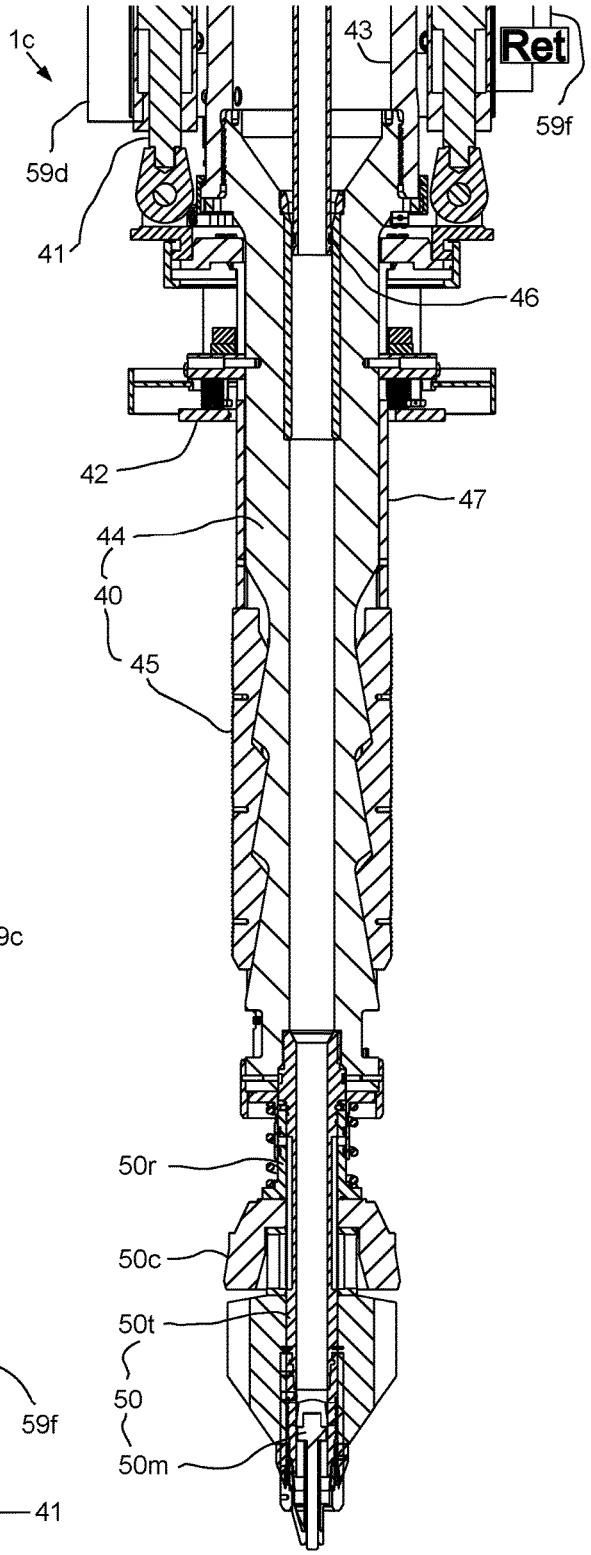

FIGS. 3A and 3B illustrate the casing unit 1*c*. The casing unit 1*c* may include the coupling 15, a clamp, such as a spear 40, an adapter 48, one or more, such as three (only one shown), hydraulic passages 49, a fill up tool 50, a genset 51, and a frame 58. The fill up tool 50 may include a flow tube 50*t*, a stab seal, such as a cup seal 50*c*, a release valve 50*r*, a mud saver valve 50*m*, a fill up valve 50*f*, and a fill up valve actuator 50*a*.

The fill up valve 50*f* may include a valve member, such as a ball, a valve seat, and a housing. The housing may be tubular, may have an upper end connected to the torso 15*r* and a lower end connected to the adapter 48. The valve seat may be disposed in the housing, may be made from a metal/alloy, ceramic/cermet, or polymer and may be connected to the housing, such as by fastening. The ball may be disposed in a spherical recess formed by the valve seat and rotatable relative to the housing between an open position (shown) and a closed position. The ball may have a bore therethrough corresponding to the housing bore and aligned therewith in the open position. A wall of the ball may close the housing bore in the closed position. The ball may have a stem extending into an actuation port formed through a wall of the housing. The stem may mate with a shaft of the actuator 50*a* and the actuator may be operable to rotate the ball between the open and the closed positions.

The fill up valve actuator 50*a* may be hydraulic and may have a position sensor Op in communication with the shaft and in communication with a microcontroller MCU of the genset 51 via a data cable 59*a*. The position sensor Op may also be electrically powered by the microcontroller MCU via the data cable 59*a*. The position sensor Op may verify that the actuator 50*a* has properly functioned to open and/or close the fill up valve 50*f*. The actuator 50*a* may be operated by one or more fluid connectors, such as hydraulic conduits 59*b,c* leading to a fluid, such as hydraulic, manifold 56 (FIG. 4) of the genset 51.

The adapter 48 may be tubular, may have a bore formed therethrough, and may have an upper end connected to the housing of the fill up valve 50*f*, and may have an outer thread and an inner receptacle formed at a lower end thereof. The frame 58 may mount the genset 51 to an outer surface of the adapter 48.

The spear 40 may include a clamp actuator, such as linear actuator 41, a bumper 42, a collar 43, a mandrel 44, a set of grippers, such as slips 45, a seal joint 46, and a sleeve 47. The collar 43 may have an inner thread formed at each longitudinal end thereof. The collar upper thread may be engaged with the outer thread of the adapter 48, thereby connecting the two members. The collar lower thread may be engaged with an outer thread formed at an upper end of the mandrel 44 and the mandrel may have an outer flange formed adjacent to the upper thread and engaged with a bottom of the collar 43, thereby connecting the two members.

The seal joint 46 may include the inner barrel, an outer barrel, and a nut. The inner barrel may have an outer thread engaged with a threaded portion of the adapter receptacle and an outer portion carrying a seal engaged with a seal bore portion of the adapter receptacle. The mandrel 44 may have a bore formed therethrough and an inner receptacle formed at an upper portion thereof and in fluid communication with the bore. The mandrel receptacle may have an upper conical portion, a threaded mid portion, and a recessed lower portion. The outer barrel may be disposed in the recessed portion of the mandrel 44 and trapped therein by engagement of an outer thread of the nut with the threaded mid portion of the mandrel receptacle. The outer barrel may have a seal bore formed therethrough and a lower portion of the inner barrel may be disposed therein and carry a stab seal engaged therewith.

The linear actuator 41 may include a housing, an upper flange, a plurality of piston and cylinder assemblies, a lower flange, and a position sensor Ret in communication with one or more of the piston and cylinder assemblies. The position sensor Ret may be also be in communication with the microcontroller MCU via a data cable 59*f*. The position sensor Ret may also be electrically powered by the microcontroller MCU via the data cable 59*f*. The position sensor Ret may verify that the piston and cylinder assemblies have properly functioned to extend and/or retract the slips 45. The housing may be cylindrical, may enclose the cylinders of the assemblies, and may be connected to the upper flange, such as by fastening. The collar 43 may also have an outer thread formed at the upper end thereof. The upper flange may have an inner thread engaged with the outer collar thread, thereby connecting the two members. Each flange may have a pair of lugs for each piston and cylinder assembly connected, such as by fastening or welding, thereto and extending from opposed surfaces thereof.

Each cylinder of the linear actuator 41 may have a coupling, such as a hinge knuckle, formed at an upper end thereof. The upper hinge knuckle of each cylinder may be received by a respective pair of lugs of the upper flange and pivotally connected thereto, such as by fastening. Each piston of the linear actuator 41 may have a coupling, such as a hinge knuckle, formed at a lower end thereof. Each piston of the linear actuator 41 may be disposed in a bore of the respective cylinder. The piston may divide the cylinder bore into a raising chamber and a lowering chamber and the cylinder may have ports formed through a wall thereof and each port may be in fluid communication with a respective chamber.

Each port may be in fluid communication with the hydraulic manifold 56 via respective fluid connectors, such as hydraulic conduits 59*d,e*. Supply of hydraulic fluid to the raising port may lift the lower flange to a retracted position (shown). Supply of hydraulic fluid to the lowering port may drop the lower flange toward an extended position (not shown). The piston and cylinder assemblies may share an extension conduit 59*e* and a retraction conduit 59*d* via a splitter (not shown).

The sleeve 47 may have an outer shoulder formed in an upper end thereof trapped between upper and lower retainers. A washer may have an inner shoulder formed in a lower end thereof engaged with a bottom of the lower retainer. The washer may be connected to the lower flange, such as by fastening, thereby longitudinally connecting the sleeve 47 to the linear actuator 41. The sleeve 47 may also have one or more (pair shown) slots formed through a wall thereof at an upper portion thereof.

The bumper 42 include a striker and a base connected to the mandrel, such as by one or more threaded fasteners, each fastener extending through a hole thereof, through a respective slot of the sleeve 47, and into a respective threaded socket formed in an outer surface of the mandrel 44, thereby also torsionally connecting the sleeve to the mandrel while allowing limited longitudinal movement of the sleeve relative to the mandrel to accommodate operation of the slips 45. The striker may be linked to the base by one or more (pair shown) compression springs. A lower portion of the spear 40 may be stabbed into the casing joint 90*j* until the striker engages a top of the casing joint. The springs may cushion impact with the top of the casing joint 90*j* to avoid damage thereto.

The sleeve 47 may extend along the outer surface of the mandrel from the lower flange of the linear actuator 41 to the slips 45. A lower end of the sleeve 47 may be connected to upper portions of each of the slips 45, such as by a flanged (i.e., T-flange and T-slot) connection. Each slip 46 may be radially movable between an extended position and a retracted position by longitudinal movement of the sleeve 47 relative to the slips. A slip receptacle may be formed in an outer surface of the mandrel 44 for receiving the slips 45. The slip receptacle may include a pocket for each slip 46, each pocket receiving a lower portion of the respective slip. The mandrel 44 may be connected to lower portions of the slips 45 by reception thereof in the pockets. Each slip pocket may have one or more (three shown) inclined surfaces formed in the outer surface of the mandrel 44 for extension of the respective slip. A lower portion of each slip 46 may have one or more (three shown) inclined inner surfaces corresponding to the inclined slip pocket surfaces.

Downward movement of the sleeve 47 toward the slips 45 may push the slips along the inclined surfaces, thereby wedging the slips toward the extended position. The lower portion of each slip 46 may also have a guide profile, such as tabs, extending from sides thereof. Each slip pocket may also have a mating guide profile, such as grooves, for retracting the slips 45 when the sleeve 47 moves upward away from the slips. Each slip 46 may have teeth formed along an outer surface thereof. The teeth may be made from a hard material, such as tool steel, ceramic, or cermet for engaging and penetrating an inner surface of the casing joint 90*j*, thereby anchoring the spear 40 to the casing joint.

The cup seal 50*c* may have an outer diameter slightly greater than an inner diameter of the casing joint 90*j* to engage the inner surface thereof during stabbing of the spear 40 therein. The cup seal 50*c* may be directional and oriented such that pressure in the casing bore energizes the seal into engagement with the casing joint inner surface. An upper end of the flow tube 50*t* may be connected to a lower end of the mandrel 44, such as by threaded couplings. The mud saver valve 50*m* may be connected to a lower end of the flow tube 50*t*, such as by threaded couplings. The cup seal 50*c* and release valve 50*r* may be disposed along the flow tube 50*t* and trapped between a bottom of the mandrel 44 and a top of the mudsaver valve 50*m*.

The spear 40 may be capable of supporting weight of the casing string 90. The string weight may be transferred to the becket 19 via the slips 45, the mandrel 44, the collar 43, the adapter 48, the coupling 15, the bayonet profile 23*b*, the down thrust bearing 27, the drive body 22. Fluid may be injected into the casing string 90 via the hose nipple 20, the mud swivel 21, the coupling 15, the adapter 48, the seal joint 46, the mandrel 44, the flow tube 50*t*, and the mud saver valve 50*m*.

Alternatively, the clamp may be a torque head instead of the spear 40. The torque head may be similar to the spear except for receiving an upper portion of the casing joint 90*j* therein and having the set of grippers for engaging an outer surface of the casing joint instead of the inner surface of the casing joint.

Figure 4:
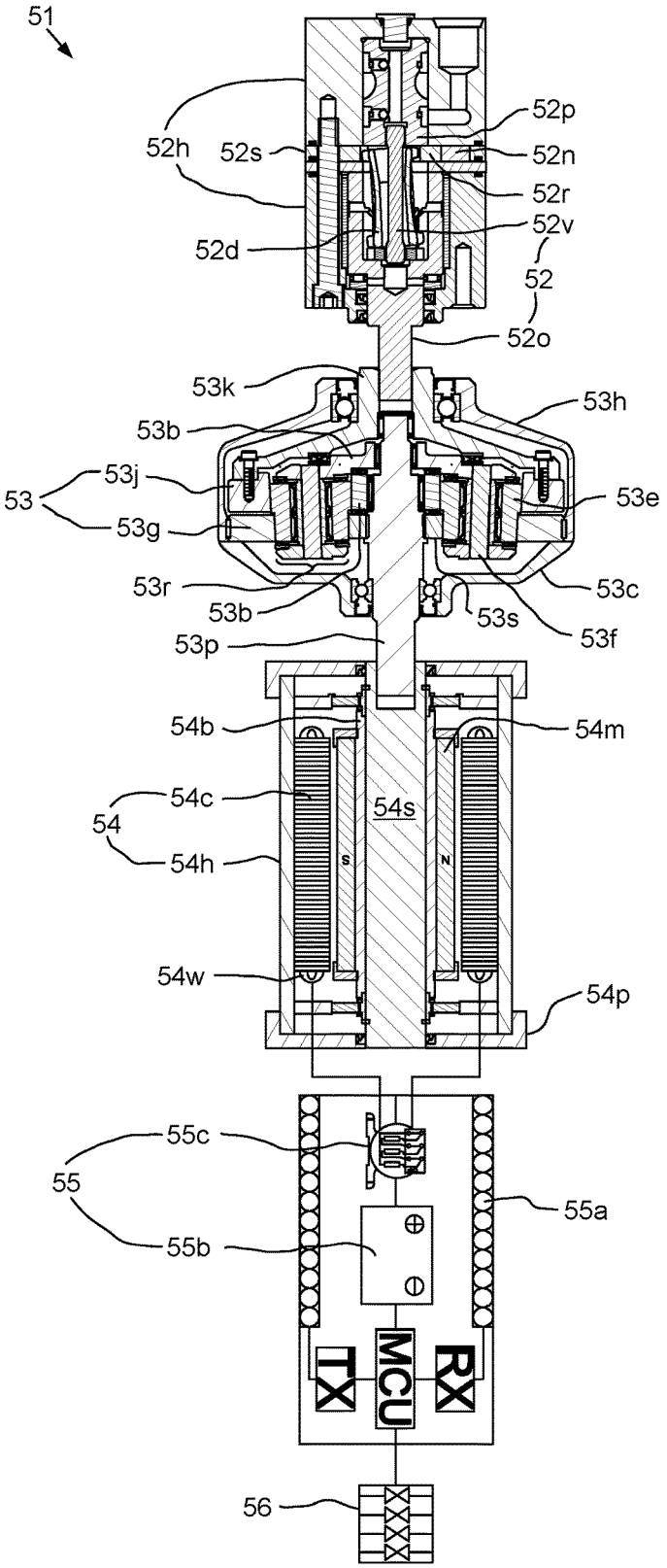
FIG. 4 illustrates a genset of the casing unit.

FIG. 4 illustrates the genset 51. The genset 51 may include a fluid driven, such as hydraulic, motor 52, a gearbox 53, an electric generator 54, a control unit 55, and the hydraulic manifold 56. The gearbox 53 may be a planetary gearbox.

Alternatively, the control swivel 26, the fluid driven motor 52, the fluid manifold 56, the linear actuator 41, and the fill up valve actuator 50*a* may be pneumatic instead of hydraulic.

The fluid driven motor 52 may be a gerotor motor and include a housing 52*h*, a drive shaft 52*d*, a valve shaft 52*v*, an output shaft 52*o*, an orbital gear set having a rotor 52*r* and a stator 52*s*, a plurality of roller vanes 52*n*, and a valve spool 52*p*. To facilitate assembly, the housing 52*h* may include two or more sections connected together, such as by one or more threaded fasteners. The output shaft 52*o* may have a hollow upper head disposed in the housing and a lower shank extending therethrough. The head may have a torsional profile, such as splines, formed in an inner surface thereof. A shaft spacer and a lower portion of the drive shaft 52*d* may each have teeth meshed with the splines, thereby torsionally connecting the members. The shaft spacer may also have a torsional profile formed in an inner surface thereof meshed with a torsional profile formed in a lower end of the valve shaft 52*v*.

The drive shaft 52*d* may be disposed in the head with a sufficient clearance formed therebetween to accommodate articulation of the drive shaft with the orbiting of the rotor 52*r*. The stator 52*s* may be disposed between the housing sections and connected thereto by the threaded fasteners. The roller vanes 52*n* may be disposed in sockets formed in the stator 52*s* and may be trapped between the housing sections. The rotor 52*r* may be disposed in the stator 52*s* and have a number of lobes formed in an outer surface thereof equal to the number of roller vanes minus one. Selective supply of pressurized hydraulic fluid by the valve spool 52*p* through pressure chambers formed between the rotor 52*r* and the stator 52*s* may drive the rotor in an orbital movement within the stator, thereby converting fluid energy from the hydraulic fluid into kinetic energy of the output shaft 52*o*.

The rotor 52*r* may have a torsional profile formed in an inner surface thereof meshed with a torsional profile formed of the upper portion of the drive shaft 52*d*, thereby torsionally connecting the two members. The valve shaft 52*v* may extend through the drive shaft 52*s* and have an upper portion with a torsional profile meshed with a torsional profile formed in a lower portion of the valve spool 52*p*. An inlet may be formed through a wall of the housing 52*h* to provide fluid communication between the valve spool 52*p* and a fluid connector, such as hydraulic conduit 57*a* leading to the hydraulic passage 49. An outlet (not shown) may be formed through a wall of the housing 52*h* to provide fluid communication between the valve spool 52*p* and a fluid connector (not shown) leading to a second hydraulic passage of the coupling 15.

The valve spool 52*p* may be disposed in the housing 52*h* and may rotate with the output shaft 52*o* via the valve shaft 52*v*. The valve spool 52*p* may have flow slots formed in an outer surface thereof that selectively provide fluid communication between the inlet and outlet and the appropriate pressure chambers formed between the rotor 52*r* and the stator 52*s*. A bushing may be disposed between the housing 52*h* and the output shaft 52*o* for radial support of the output shaft therefrom. A thrust bearing may be disposed between the housing 52*h* and the output shaft 52*o* for longitudinal support of the output shaft therefrom. One or more (pair shown) dynamic seals may be disposed between the housing 52*h* and the output shaft 52*o* to isolate the rotating interface therebetween for prevention of loss of hydraulic fluid from the fluid driven motor 52 and for prevention of contaminants from entering therein.

The gear box 53 may be planetary and include a housing 53*h* and a cover 53*c* connected thereto, such as by fasteners (not shown). The housing 53*h* and cover 53*c* may enclose a lubricant chamber sealed at ends thereof by oil seals. The gear box 53 may further include an input disk 53*k* having a hub extending from an upper end of the lubricant chamber and torsionally connected to the output shaft 52*o* of the fluid driven motor 52 by mating profiles (not shown), such as splines, formed at adjacent ends thereof. The gear box 53 may further include an output shaft 53*p* extending from a lower end of the lubricant chamber and torsionally connected to a shaft 54*s* of the electric generator 54 by mating profiles (not shown), such as splines, formed at adjacent ends thereof.

Each of the output shaft 53*p* and input disk 53*k* may be radially supported from the respective cover 53*c* and housing 53*h* for rotation relative thereto by respective bearings. The hub of the input disk 53*k* may receive an end of the output shaft 53*p* and a needle bearing may be disposed therebetween for supporting the output shaft therefrom while allowing relative rotation therebetween. A sun gear 53*s* may be disposed in the lubricant chamber and may be mounted onto the output shaft 53*p*. A stationary housing gear 53*g* may be disposed in the lubricant chamber and mounted to the housing 53*h*. A plurality of planetary rollers 53*r* may also be disposed in the lubricant chamber.

Each planetary roller 53*r* may include a planetary gear 53*e* disposed between and meshed with the sun gear 53*s* and the housing gear 53*g*. The planetary gears 53*e* may be linked by a carrier 53*b* which may be radially supported from the output shaft 53*p* by a bearing to allow relative rotation therebetween. Each planetary roller 53*r* may further include a support shaft 53*f* which is supported at its free end by a support ring and on which the respective planetary gear 53*e* may be supported by a bearing. Each planetary gear 53*e* may include first and second sections of different diameters, the first section meshing with the housing gear 53*g* and the sun gear 53*s* and the second section meshing with an input gear 53*j* and a support gear 53*b*. The input gear 53*j* may be mounted to the input disk 53*k* by fasteners. The support gear 53*b* may be radially supported from the input shaft 53*p* by a bearing to allow relative rotation therebetween.

The support shafts 53*f* may be arranged at a slight angle with respect to longitudinal axes of the output shaft 53*p* and input disk 53*k*. The planetary gears 53*e*, housing gear 53*g*, input gear 53*j*, and support gear 53*b* may also be slightly conical so that, upon assembly of the gear box 53, predetermined traction surface contact forces may be generated. The gear box 53 may further include assorted thrust bearings disposed between various members thereof.

In operation, rotation of the input disk 53*k* by the fluid driven motor 52 may drive the input gear 53*j*. The input gear 53*j* may drive the planetary gears 53*e* to roll along the housing gear 53*g* while also driving the sun gear 53*s*. Since the diameter of the second section of each planetary gear 53*e* may be significantly greater than that of the first section, the circumferential speed of the second section may correspondingly be significantly greater than that of the first section, thereby providing for a speed differential which causes the output shaft 53*p* to counter-rotate at a faster speed corresponding to the difference in diameter between the planetary gear sections. Driving torque of the output shaft 53*p* is also reduced accordingly.

Alternatively, the diameter of the first section of each planetary gear 53*e* may be greater in diameter than that of the second section resulting in rotation of the input gear 53*j* in the same direction as the input shaft 53*p* again at a speed corresponding to the difference in diameter between the two sections.

The electric generator 54 may include a rotor, a stator, and a pair of bearings supporting the rotor for rotation relative to the stator. The electric generator 54 may be a permanent magnet generator. For example, the rotor may include a hub 54*b* made from a magnetically permeable material, a plurality of permanent magnets 54*m* torsionally connected to the hub, and a shaft 54*s*. The rotor may include one or more pairs of permanent magnets 54*m* having opposite polarities N,S. The permanent magnets 54*m* may also be fastened to the hub 54*b*, such as by retainers. The hub 54*b* may be torsionally connected to the shaft 54*s* and fastened thereto. The stator may include a housing 54*h*, a core 54*c*, a pair of end caps 54*p*, and a plurality of windings 54*w*, such as three (only two shown). The core 54*c* may include a stack of laminations made from a magnetically permeable material. The stack may have lobes formed therein, each lobe for receiving a respective winding. The core 54*c* may be longitudinally and torsionally connected to the housing 54*h*, such as by an interference fit.

The control unit 55 may include a power converter 55*c*, an electrical energy storage device, such as a battery 55*b*, the microcontroller MCU, a wireless data link. The wireless data link may include a transmitter TX, a receiver RX, an antenna 55*a*. The transmitter TX and receiver RX may be separate devices (as shown) or may be integrated into a single transceiver. The transmitter TX and receiver RX may share the single antenna 55*a* (shown) or each have their own antenna. The wireless data link may be half-duplex or full-duplex. The power converter 55*c* may have an input in electrical communication with each winding 54*w* of the electric generator 54 and an output in electrical communication with the battery 55*b*. The power converter 55*c* may receive a multi-phase, such as three phase, power signal from the electric generator 54 and convert the power signal into a direct current power signal for charging the battery 55*b*. The power converter 55*c* may also step-down a voltage of the power signal from the electric generator 54 to a voltage usable by the battery 55*b*, such as three, six, nine, twelve, or twenty-four volts. The battery 55*b* may also be in electrical communication with the microcontroller MCU. The transmitter TX may be in electrical communication with the microcontroller MCU and the antenna 55*a* and may include an amplifier, a modulator, and an oscillator. The receiver RX may be in electrical communication with the microcontroller MCU and the antenna 55*a* and may include an amplifier, a demodulator, and a filter. The microcontroller MCU may receive instruction signals, via the antenna 55*a* and receiver RX, from a control console 62 (FIG. 5) to operate the fill up valve actuator 50*a* and/or the linear actuator 41 in response thereto. The instruction signals may be radio frequency wireless signals and may also be digital. The instruction signals may be received or transmitted with the used of the wireless data link. The microcontroller MCU may receive position statuses from the position sensors Op, Ret, and may send the position statuses to the control console 62 via the antenna 55*a* and transmitter TX.

Alternatively, the electrical energy storage device may be a super-capacitor, capacitor, or inductor instead of a battery.

The hydraulic manifold 56 may include a plurality of control valves, such as directional control valves, for operating the fill up valve actuator 50*a* and the linear actuator 41. Each control valve may be operated by an electric actuator (not shown) in electrical communication with the microcontroller MCU. An inlet of the hydraulic manifold 56 may be in fluid communication with the hydraulic passage 49 via a fluid connector, such as hydraulic conduit 57*b*. The inlet of the hydraulic manifold 56 may also be in fluid communication with the second hydraulic passage of the coupling 15 via another fluid connector, such as hydraulic conduit 57*c*. The inlet of the hydraulic manifold 56 may also be in fluid communication with a third hydraulic passage of the coupling 15 via another fluid connector, such as hydraulic conduit 57*d*. The hydraulic conduits 57*a,b* may both be in simultaneous fluid communication with the hydraulic passage 49 via a splitter.

When the casing unit 1*c* is connected to the motor unit 1*m*, the hydraulic conduit 64*c* may be connected to the hydraulic conduits 57*a,b* via the control swivel 26 and the hydraulic passage 49. The hydraulic conduit 64*d* may be connected to the hydraulic conduit 57*c* and the outlet of the fluid driven motor 52 via the control swivel 26 and the second hydraulic passage of the coupling 15. The hydraulic conduit 64*e* may be connected to the hydraulic conduit 57*d* via the control swivel 26 and the second hydraulic passage of the coupling 15. The hydraulic conduit 64*c* may be a supply line. The hydraulic conduit 64*d* may be a return line. The hydraulic conduit 64*e* may be a drain line. The microcontroller MCU may operate the hydraulic manifold 56 to selectively provide fluid communication between the hydraulic conduits 57*b-d* and the hydraulic conduits 59*b-e* based on the instruction signals from the control console 62.

Also as the casing unit 1*c* is connected to the motor unit 1*m*, the genset 51 may receive hydraulic fluid from the HPU 60 via the hydraulic conduit 57*a*, hydraulic passage 49, and hydraulic conduit 64*c* and return spent hydraulic fluid to the HPU via the hydraulic conduit leading from the second hydraulic passage of the coupling 15, the second hydraulic passage of the coupling, and the hydraulic conduit 64*d*, thereby driving the fluid driven motor 52. The fluid driven motor 52 may in turn drive the electric generator 54 via the gearbox 53. The electric generator 54 may power the control unit 55 which may await instruction signals from the control console 62 to operate the spear 40 and/or the fill up valve 50*f* via the hydraulic manifold 56.

FIG. 5 is a control diagram of the top drive system 1 in the drilling mode. The HPU 60 may include a pump 60*p*, a check valve 60*k*, an accumulator 60*a*, a reservoir 60*r* of hydraulic fluid, and the HPU manifold 60*m*. The motor driver 61 may be one or more (three shown) phase and include a rectifier 61*r* and an inverter 61*i*. The inverter 61*i* may be capable of speed control of the drive motors 18, such as being a pulse width modulator. Each of the HPU manifold 60*m* and motor driver 61 may be in data communication with the control console 62 for control of the various functions of the top drive system 1. The top drive system 1 may further include a video monitoring unit 63 having a video camera 63*c* and a light source 63*g* such that a technician (not shown) may visually monitor operation thereof from the rig floor 7*f* or control room (not shown) especially during shifting of the modes. The video monitoring unit 63 may be mounted on the motor unit 1*m*.

The pipe handler control lines 66*b,c* may flexible control lines such that the pipe handler 1*p* remains connected thereto in any position thereof.

The motor unit 1*m* may further include a proximity sensor 68 connected to the swivel frame 30 for monitoring a position of the lock ring flange 34*f*. The proximity sensor 68 may include a transmitting coil, a receiving coil, an inverter for powering the transmitting coil, and a detector circuit connected to the receiving coil. A magnetic field generated by the transmitting coil may induce eddy current in the turns gear lock ring flange 34*f* which may be made from an electrically conductive metal or alloy. The magnetic field generated by the eddy current may be measured by the detector circuit and supplied to the control console 62 via control line 65.

FIGS. 6, 7A, 7B, 8A, and 8B illustrate shifting of the top drive system 1 to the drilling mode. The unit handler 1*u* may be operated to engage the holder 5 with the torso 15*r* of the drilling unit 1*d*. Once engaged, the arm 4 may be raised slightly to shift weight of the drilling unit 1*d* from the unit rack 1*k* to the holder 5. The respective motor 14*m* may then be operated to rotate the respective ring gear 14*g* until the external prongs of the respective head 15*h* are aligned with the internal prong-ways of the ring gear (and vice versa), thereby freeing the head for passing through the ring gear. The arm 4 may then be lowered, thereby passing the drilling unit 1*d* through the respective ring gear 14*g*. The unit handler 1*u* may be operated to move the drilling unit 1*d* away from the unit rack 1*k* until the drilling unit is clear of the unit rack. The arm 4 may be raised to lift the drilling unit 1*d* above the rig floor 7*f*. The unit handler 1*u* may be operated to horizontally move the drilling unit 1*d* into alignment with the motor unit 1*m*.

The arm 4 may then be raised to lift the drilling unit 1*d* until the respective head 15*h* is adjacent to the bottom of the drive gear 23. The drive motors 18 may then be operated to rotate the drive gear 23 until the external prongs of the respective head 15*h* are aligned with the internal prong-ways of the bayonet profile 23*b* and at a correct orientation so that when the drive gear is rotated to engage the bayonet profile with the respective head 15*h*, the asymmetric profiles of the hydraulic junction 36 will be aligned. The drive gear 23 may have visible alignment features (not shown) on the bottom thereof to facilitate use of the camera 63*c* for obtaining the alignment and the orientation. Once aligned and oriented, the arm 4 may be raised to lift the coupling 15 of the drilling unit 1*d* into the drive gear 23 until the respective head 15*h* is aligned with the locking profile 23*k* thereof. The lock ring 34 may be in a lower position, such as the hoisting position, such that the top of the respective head 15*h* contacts the lock ring and pushes the lock ring upward. The proximity sensor 68 may then be used to determine alignment of the respective head 15*h* with the locking profile 23*k* by measuring the vertical displacement of the lock ring 34. Once alignment has been achieved, the compensator actuator 33 may be operated to move the lock ring 34 to the ready position.

The drive motors 18 may then be operated to rotate the drive gear 23 until sides of the external prongs of the respective head 15*h* engage respective stop lugs of the locking profile 23*k*, thereby aligning the external prongs of the respective head with the internal prongs of the bayonet profile 23*b* and correctly orienting the profiles of the hydraulic junction 36. In some embodiments, the compensator actuator 33 may then be operated to move the lock ring 34 to the hoisting position, thereby moving the lugs of the locking profile 34*k* into the external prong-ways of the respective head 15*h* and aligning the lock pins 35 with the respective slots 15*t*. Movement of the lock ring 34 also stabs the male members 34*m* into the respective female members 15*f*, thereby forming the hydraulic junction 36. The proximity sensor 68 may again be monitored to ensure that the bayonet profiles 23*b* have properly engaged and are not jammed. Hydraulic fluid may then be supplied to the extension portions of the chambers housing the lock pins 35 via the control line 64*a*, thereby moving the lock pins radially inward and into the respective slots 15*t*. The locking profile 23*k* may have a sufficient length to maintain a torsional connection between the drilling unit 1*d* and the drive gear 23 in and between the ready and hoisting positions of the compensator 25. The drilling unit 1*d* is now longitudinally and torsionally connected to the drive gear 23.

The tilt actuator of the backup wrench 29 may then be operated to pivot the arm 29*a* and tong 29*t* about the hinge 29*h* and into alignment with the drilling unit 1*d*. The linear actuator of the backup tong 29 may then be operated via the cable 67*a* to move the tong 29*t* upward along the arm 29*a* until the tong is positioned adjacent to the quill 37. The top drive system 1 is now in the drilling mode.

Figure 9:
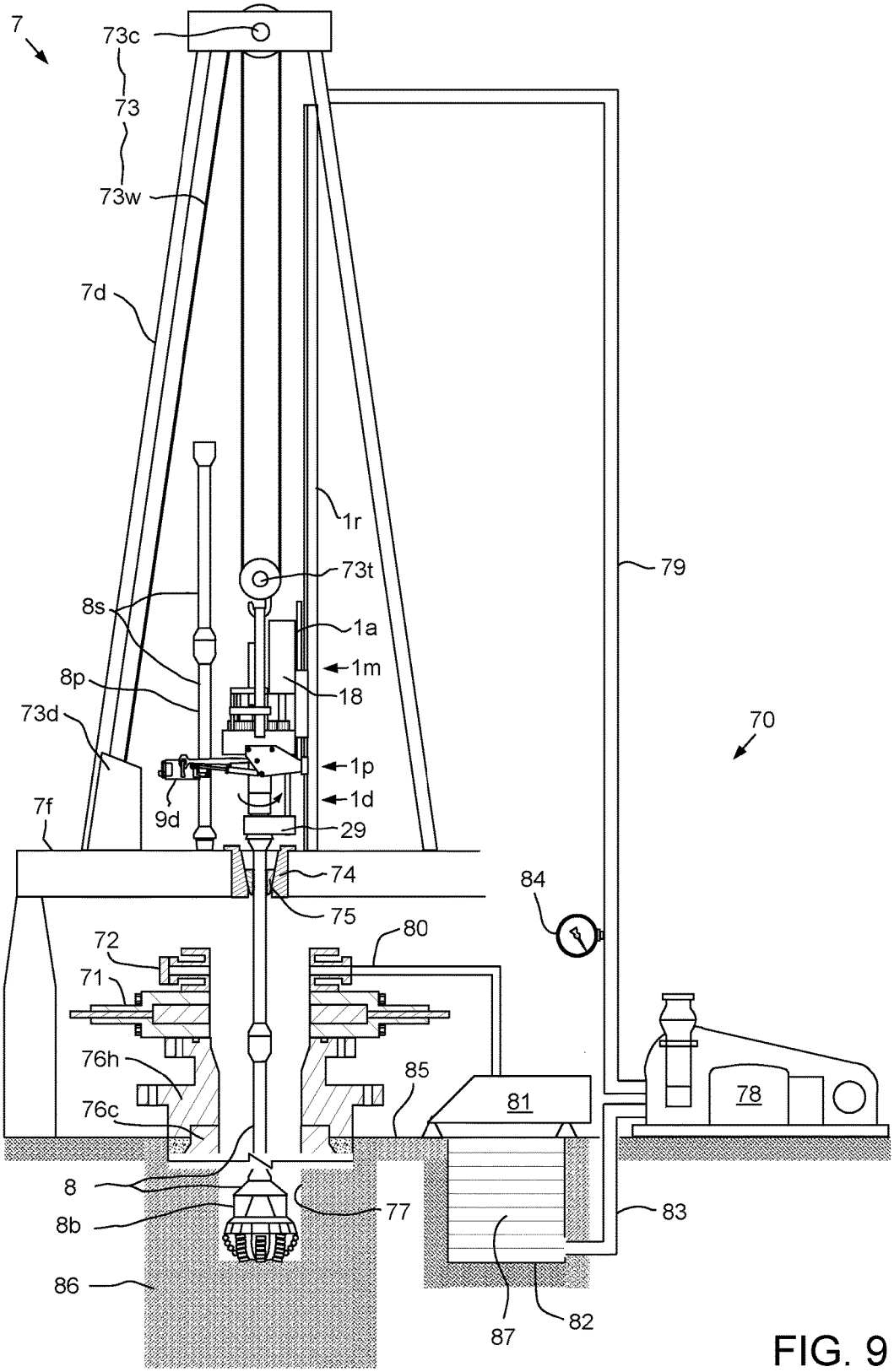
FIG. 9 illustrates the top drive system in the drilling mode.

FIG. 9 illustrates the top drive system 1 in the drilling mode. The drilling rig 7 may be part of a drilling system. The drilling system may further include a fluid handling system 70, a blowout preventer (BOP) 71, a flow cross 72 and the drill string 8. The drilling rig 7 may further include a hoist 73, a rotary table 74, and a spider 75. The rig floor 7*f* may have the opening through which the drill string 8 extends downwardly through the flow cross 72, BOP 71, and a wellhead 76*h*, and into a wellbore 77.

The hoist 73 may include the drawworks 73*d*, wire rope 73*w*, a crown block 73*c*, and the traveling block 73*t*. The traveling block 73*t* may be supported by wire rope 73*w* connected at its upper end to the crown block 73*c*. The wire rope 73*w* may be woven through sheaves of the blocks 73*c,t* and extend to the drawworks 73*d* for reeling thereof, thereby raising or lowering the traveling block 73*t* relative to the derrick 13*d*.

The fluid handling system 70 may include a mud pump 78, the standpipe 79, a return line 80, a separator, such as shale shaker 81, a pit 82 or tank, a feed line 83, and a pressure gauge 84. A first end of the return line 80 may be connected to the flow cross 72 and a second end of the return line may be connected to an inlet of the shaker 81. A lower end of the standpipe 79 may be connected to an outlet of the mud pump 78 and an upper end of the standpipe may be connected to the mud hose. A lower end of the feed line 83 may be connected to an outlet of the pit 82 and an upper end of the feed line may be connected to an inlet of the mud pump 78.

The wellhead 76*h* may be mounted on a conductor pipe 76*c*. The BOP 71 may be connected to the wellhead 76*h* and the flow cross 72 may be connected to the BOP, such as by flanged connections. The wellbore 77 may be terrestrial (shown) or subsea (not shown). If terrestrial, the wellhead 76*h* may be located at a surface 85 of the earth and the drilling rig 7 may be disposed on a pad adjacent to the wellhead. If subsea, the wellhead 76*h* may be located on the seafloor or adjacent to the waterline and the drilling rig 7 may be located on an offshore drilling unit or a platform adjacent to the wellhead.

The drill string 8 may include a bottomhole assembly (BHA) 8*b* and a stem. The stem may include joints of the drill pipe 8*p* connected together, such as by threaded couplings. The BHA 8*b* may be connected to the stem, such as by threaded couplings, and include a drill bit and one or more drill collars (not shown) connected thereto, such as by threaded couplings. The drill bit may be rotated by the motor unit 1*m* via the stem and/or the BHA 8*b* may further include a drilling motor (not shown) for rotating the drill bit. The BHA 8*b* may further include an instrumentation sub (not shown), such as a measurement while drilling (MWD) and/or a logging while drilling (LWD) sub.

The drill string 8 may be used to extend the wellbore 77 through an upper formation 86 and/or lower formation (not shown). The upper formation may be non-productive and the lower formation may be a hydrocarbon-bearing reservoir. During the drilling operation, the mud pump 78 may pump the drilling fluid 87 from the pit 82, through the standpipe 79 and mud hose to the motor unit 1*m*. The drilling fluid may include a base liquid. The base liquid may be refined or synthetic oil, water, brine, or a water/oil emulsion. The drilling fluid 87 may further include solids dissolved or suspended in the base liquid, such as organophilic clay, lignite, and/or asphalt, thereby forming a mud.

The drilling fluid 87 may flow from the standpipe 79 and into the drill string 8 via the motor 1*m* and drilling 1*d* units. The drilling fluid 87 may be pumped down through the drill string 8 and exit the drill bit, where the fluid may circulate the cuttings away from the bit and return the cuttings up an annulus formed between an inner surface of the wellbore 77 and an outer surface of the drill string 8. The drilling fluid 87 plus cuttings, collectively returns, may flow up the annulus to the wellhead 76*h* and exit via the return line 80 into the shale shaker 81. The shale shaker 81 may process the returns to remove the cuttings and discharge the processed fluid into the mud pit 82, thereby completing a cycle. As the drilling fluid 87 and returns circulate, the drill string 8 may be rotated by the motor unit 1*m* and lowered by the traveling block 73*t*, thereby extending the wellbore 77.

Figure 10:
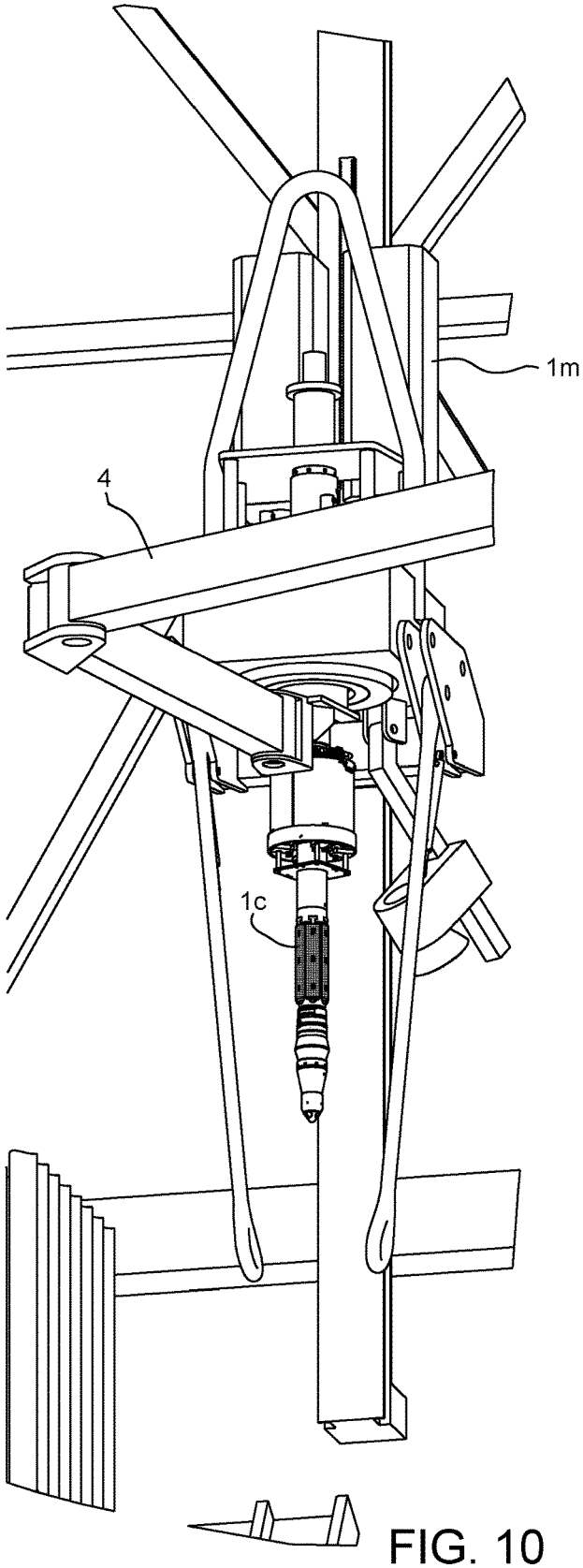
FIG. 10 illustrates shifting of the top drive system from the drilling mode to the casing mode.

FIG. 10 illustrates shifting of the top drive system 1 from the drilling mode to the casing mode. Once drilling the formation 86 has been completed, the drill string 8 may be tripped out from the wellbore 77. Once the drill string 8 has been retrieved to the rig 7, the drilling unit 1*d* may be released from the motor unit 1*m* and loaded onto the unit rack 1*k*. The top drive system 1 may then be shifted into the casing mode by repeating the steps discussed above in relation to FIGS. 6-8B for the casing unit 1*c*.

Figure 11:
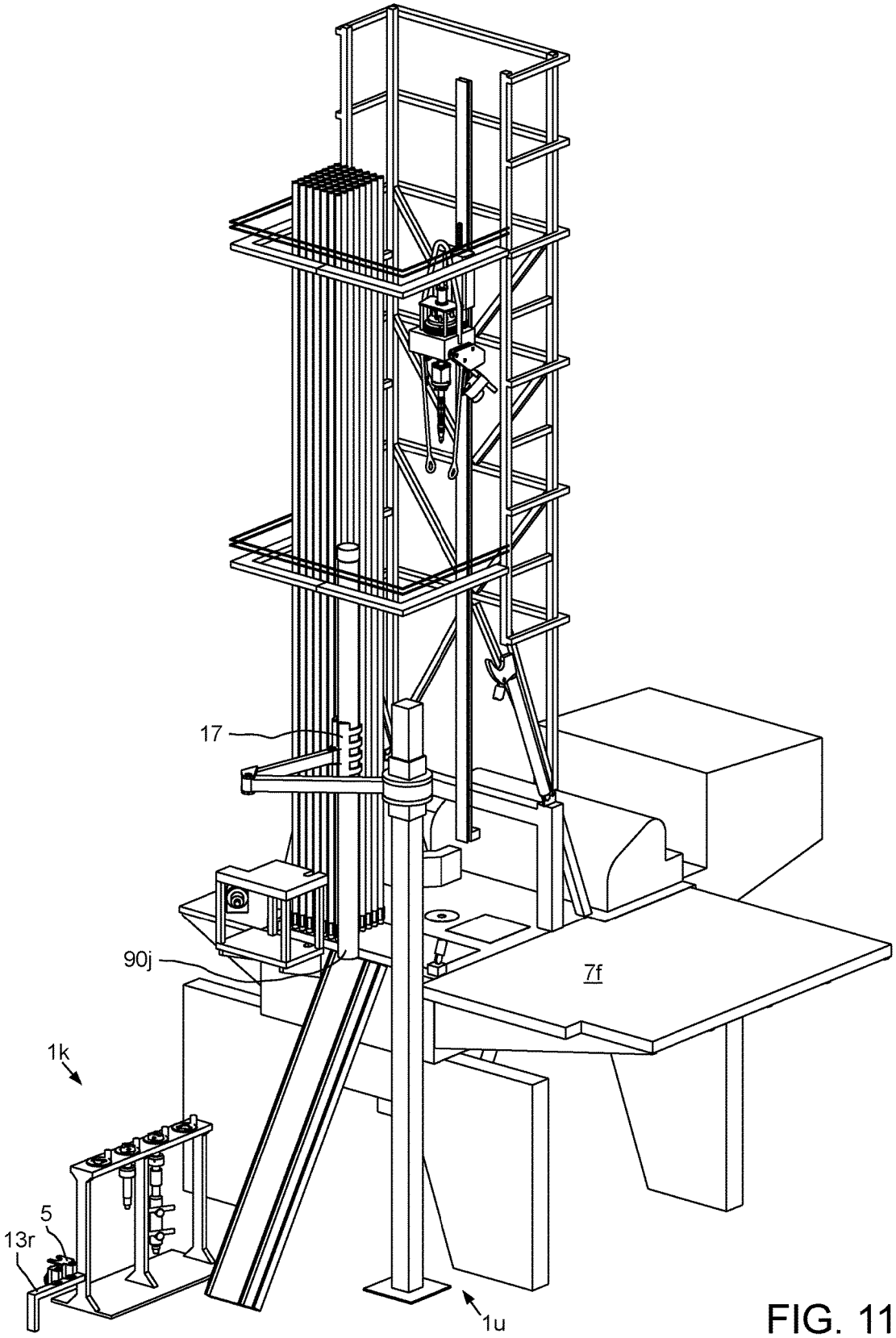
FIGS. 11 and 12A illustrate extension of a casing string using the top drive system in the casing mode.

FIGS. 11 and 12A illustrate extension of a casing string 90 using the top drive system 1 in the casing mode. Once the casing unit 1*c* has been connected to the motor unit 1*m*, the holder 5 may be disconnected from the arm 4 and stowed on the side bar 13*r*. The pipe clamp 17 may then be connected to the arm 4 and the unit handler 1*u* operated to engage the pipe clamp with the casing joint 90*j*. The pipe clamp 17 may be manually actuated between an engaged and disengaged position or include an actuator, such as a hydraulic actuator, for actuation between the positions. The casing joint 90*j* may initially be located on the subfloor structure and the unit handler 1*u* may be operated to raise the casing joint to the rig floor 7*f* and into alignment with the casing unit 1*c* and the unit handler 1*h* may hold the casing joint while the spear 40 and fill up tool 50 are stabbed into the casing joint.

Just before stabbing, the compensator 25 may be stroked upward and the pressure regulator of the HPU manifold 60*m* may be operated to maintain the compensator actuator 33 at a sensing pressure, such as slightly less than the pressure required to support weight of the lock ring 34 and casing unit 1*c*, such that the compensator 25 drifts to the hoisting position. During stabbing, the bumper 42 may engage a top of the casing joint 90*j* and the proximity sensor 68 may be monitored by the control console 62 to detect stroking of the compensator 25 to the ready position. The camera 63*c* may also observe stabbing of the spear 40 into the casing joint 90*j*. Once stabbed, the spear slips 45 may be engaged with the casing joint 90*j* by operating the linear actuator 41.

The compensator 25 may be stroked upward and the pressure regulator of the HPU manifold 60*m* may be operated to maintain the compensator actuator 33 at a second sensing pressure, such as slightly less than the pressure required to support weight of the lock ring 34, casing unit 1*c*, and casing joint 90*j*, such that the compensator 25 drifts to the hoisting position. The motor 1*m* and casing 1*c* units, pipe handler 1*p*, and casing joint 90*j* may be lowered by operation of the hoist 73 and a bottom coupling of the casing joint stabbed into the top coupling of the casing string 90. During stabbing, the proximity sensor 68 may be monitored by the control console 62 to detect stroking of the compensator 25 to the ready position and the hoist 73 may be locked at the ready position.

The rotary table 74 may be locked or a backup tong (not shown) may be engaged with the top coupling of the casing string 90 and the drive motors 18 may be operated to spin and tighten the threaded connection between the casing joint 90*j* and the casing string 90. The hydraulic pressure may be maintained in the linear actuator 33 corresponding to the weight of the lock ring 34, casing unit 1*c*, and casing joint 90*j* so that the threaded connection is maintained in a neutral condition during makeup. The pressure regulator of the HPU manifold 60*m* may relieve fluid pressure from the linear actuator 33 as the casing joint 90*j* is being madeup to the casing string 90 to maintain the neutral condition while the compensator 25 strokes downward to accommodate the longitudinal displacement of the threaded connection.

Figure 12B:
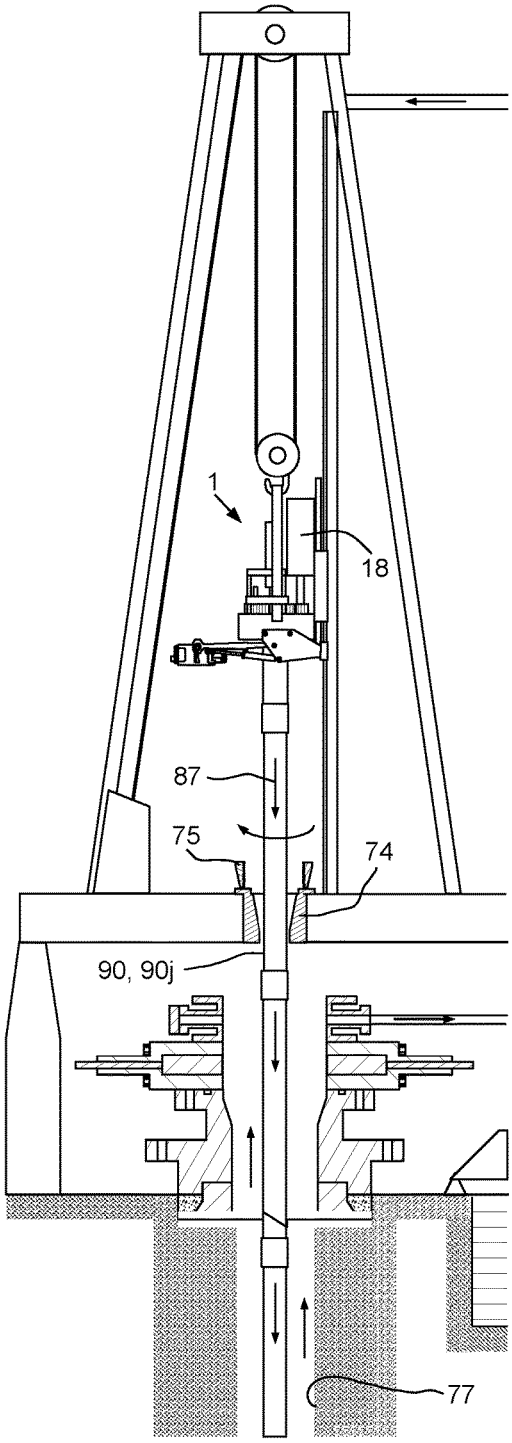
FIG. 12B illustrates running of the extended casing string into the wellbore using the top drive system.

FIG. 12B illustrates running of the extended casing string 90, 90*j* into the wellbore 77 using the top drive system 1. The HPU manifold 60*m* may be operated to pressurize the linear actuator 33 to exert the downward preload onto the lock ring 34. The spider 75 may then be removed from the rotary table 74 to release the extended casing string 90, 90*j* and running thereof may continue. Injection of the drilling fluid 87 into the extended casing string 90, 90*j* and rotation thereof by the drive motors 18 allows the casing string to be reamed into the wellbore 77.

Alternatively, the casing string 90 may be drilled into the formation 86, thereby simultaneously extending the wellbore 77 and deploying the casing string into the wellbore.

Figures 13A, 13B:
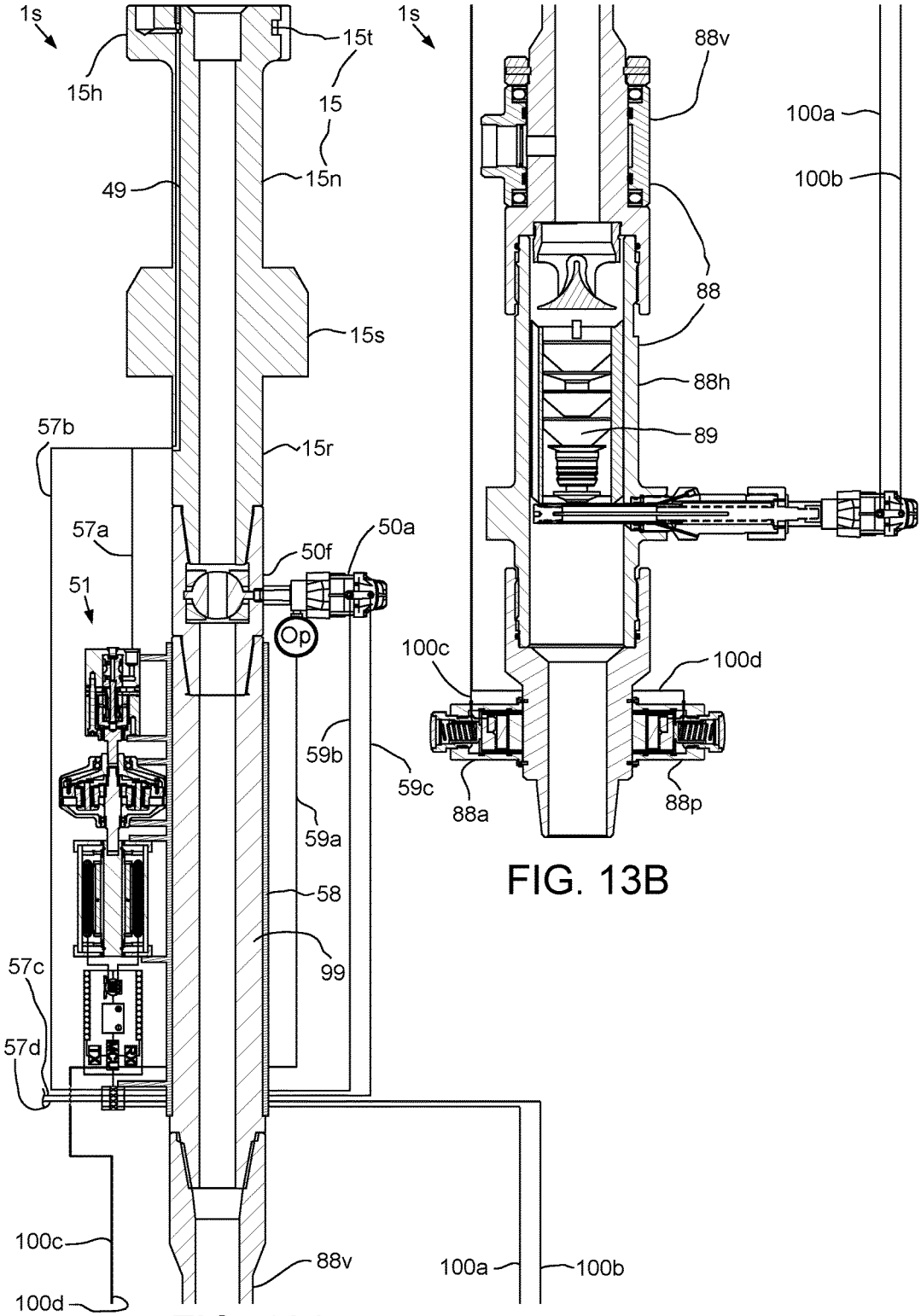
FIGS. 13A and 13B illustrate a cementing unit of the top drive system.

FIGS. 13A and 13B illustrate the cementing unit 1*s* of the top drive system 1. The cementing unit 1*s* may include the coupling 15, the fill up valve 50*f* and actuator 50*a* (repurposed as a top drive isolation valve), an adapter 99, the genset 51, the frame 58, the hydraulic passages 49, and a cementing head 88. The cementing head 88 may include a cementing swivel 88*v*, a launcher 88*h*, a release plug, such as a dart 89, and a dart detector. The adapter 99 may similar to the adapter 48 except for having a lower connector, such as a threaded coupling, suitable for mating with the cementing head 88.

The cementing swivel 88*v* may include a housing torsionally connected to the drive body 22 or derrick 7*d*, such as by an arrestor (not shown). The cementing swivel 88*v* may further include a mandrel and bearings for supporting the housing from the mandrel while accommodating rotation of the mandrel. An upper end of the mandrel may be connected to a lower end of the adapter 99, such as by threaded couplings. The cementing swivel 88*v* may further include an inlet formed through a wall of the housing and in fluid communication with a port formed through the mandrel and a seal assembly for isolating the fluid communication between the inlet and the port. The mandrel port may provide fluid communication between a bore of the cementing head 88 and the housing inlet.

Figure 14:
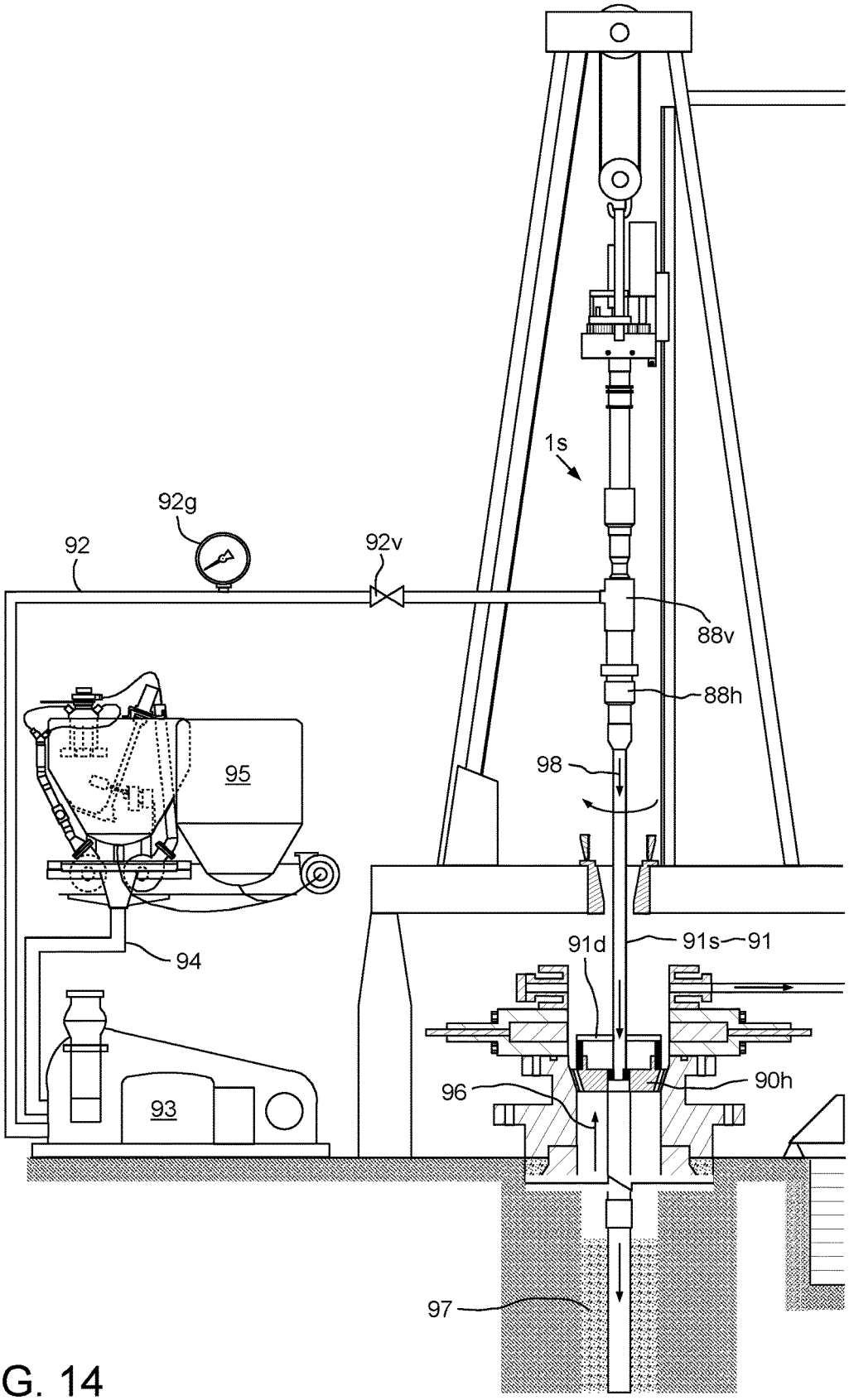
FIG. 14 illustrates cementing of the casing string using the top drive system in a cementing mode.

The launcher 88*h* may include a body, a deflector, a canister, a gate, the actuator, and a crossover. The body may be tubular and may have a bore therethrough. An upper end of the body may be connected to a lower end of the cementing swivel 88*v*, such as by threaded couplings, and a lower end of the body may be connected to the crossover, such as by threaded couplings. The canister and deflector may each be disposed in the body bore. The deflector may be connected to the cementing swivel mandrel, such as by threaded couplings. The canister may be longitudinally movable relative to the body. The canister may be tubular and have ribs formed along and around an outer surface thereof. Bypass passages (only one shown) may be formed between the ribs. The canister may further have a landing shoulder formed in a lower end thereof for receipt by a landing shoulder of the adapter. The deflector may be operable to divert fluid received from a cement line 92 (FIG. 14) away from a bore of the canister and toward the bypass passages. The crossover may have a threaded coupling, such as a threaded pin, formed at a lower end thereof for connection to a work string 91 (FIG. 14).

The dart 89 may be disposed in the canister bore. The dart 89 may be made from one or more drillable materials and include a finned seal and mandrel. The mandrel may be made from a metal or alloy and may have a landing shoulder and carry a landing seal for engagement with the seat and seal bore of a wiper plug (not shown) of the work string 91.

The gate of the launcher 88*h* may include a housing, a plunger, and a shaft. The housing may be connected to a respective lug formed in an outer surface of the launcher body, such as by threaded couplings. The plunger may be radially movable relative to the body between a capture position and a release position. The plunger may be moved between the positions by a linkage, such as a jackscrew, with the shaft. The shaft may be connected to and rotatable relative to the housing. The actuator may be fluid driven, such as a hydraulic, motor, operable to rotate the shaft relative to the housing. The actuator may include an inlet and an outlet in fluid communication with the hydraulic manifold 56 via respective conduits 100*a,b*.

In operation, when it is desired to launch the dart 89, the console 62 may be operated to supply hydraulic fluid to the launcher actuator via a control line 56 extending to the control swivel 26 and a control line extending from the control swivel to the HPU manifold 60*m*. The launcher actuator may then move the plunger to the release position. The canister and dart 89 may then move downward relative to the launcher body until the landing shoulders engage. Engagement of the landing shoulders may close the canister bypass passages, thereby forcing chaser fluid 98 (FIG. 14) to flow into the canister bore. The chaser fluid 98 may then propel the dart 89 from the canister bore, down a bore of the crossover, and onward through the work string 91.

Alternatively, the control swivel 26 and launcher actuator may be pneumatic or electric. Alternatively, the launcher actuator may be linear, such as a piston and cylinder. Alternatively, the launcher 88*h* may include a main body having a main bore and a parallel side bore, with both bores being machined integral to the main body. The dart 89 may be loaded into the main bore, and a dart releaser valve may be provided below the dart to maintain it in the capture position. The dart releaser valve may be side-mounted externally and extend through the main body. A port in the dart releaser valve may provide fluid communication between the main bore and the side bore. In a bypass position, the dart 89 may be maintained in the main bore with the dart releaser valve closed. Fluid may flow through the side bore and into the main bore below the dart via the fluid communication port in the dart releaser valve. To release the dart 89, the dart releaser valve may be turned, such as by ninety degrees, thereby closing the side bore and opening the main bore through the dart releaser valve. The chaser fluid 98 may then enter the main bore behind the dart 89, thereby propelling the dart into the work string 91.

The dart detector may include one or more ultrasonic transducers, such as an active transducer 88*a* and a passive transducer 88*p*. Each transducer 88*a,p* may include a respective: bell, a knob, a cap, a retainer, a biasing member, such as compression spring, a linkage, such as a spring housing, and a probe. Each bell may have a respective flange formed in an inner end thereof for longitudinal and torsional connection to an outer surface of the crossover, such as by one or more respective fasteners. The transducers 88*a,p* may be arranged on the crossover in alignment and in opposing fashion, such as being spaced around the crossover by one hundred eighty degrees. Each bell may have a cavity formed in an inner portion thereof for receiving the respective probe and a smaller bore formed in an outer portion thereof for receiving the respective knob.

Each knob may be linked to the respective bell, such as by mating lead screws formed in opposing surfaces thereof. Each knob may be tubular and may receive the respective spring housing in a bore thereof. Each knob may have a first thread formed in an inner surface thereof adjacent to an outer end thereof for receiving the respective cap. Each knob may also have a second thread formed in an inner surface thereof adjacent to the respective first thread for receiving the respective retainer.

Each spring housing may be tubular and have a bore for receiving the respective spring and a closed inner end for trapping an inner end of the spring therein. An outer end of each spring may bear against the respective retainer, thereby biasing the respective probe into engagement with the outer surface of the crossover. A compression force exerted by the spring against the respective probe may be adjusted by rotation of the knob relative to the respective bell. Each knob may also have a stop shoulder formed in an inner surface and at a mid-portion thereof for engagement with a stop shoulder formed in an outer surface of the respective spring housing.

Each probe may include a respective: shell, jacket, backing, vibratory element, and protector. Each shell may be tubular and have a substantially closed outer end for receiving a coupling of the respective spring housing and a bore for receiving the respective backing, vibratory element, and protector. Each bell may carry one or more seals in an inner surface thereof for sealing an interface formed between the bell and the respective shell. Each seal may be made from an elastomer or elastomeric copolymer and may additionally serve to acoustically isolate the respective probe from the respective bell. Each bell and each shell may be made from a metal or alloy, such as steel or stainless steel. Each backing may be made from an acoustically absorbent material, such as an elastomer, elastomeric copolymer, or acoustic foam. The elastomer or elastomeric copolymer may be solid or have voids formed throughout.

Each vibratory element may be a disk made from a piezoelectric material, such as natural crystal, synthetic crystal, electroceramic, such as perovskite ceramic, a polymer, such as polyvinylidene fluoride, or organic nanostructure. A peripheral electrode may be deposited on an inner face and side of each vibratory element and may overlap a portion of an outer face thereof. A central electrode may be deposited on the outer face of each vibratory element. A gap may be formed between the respective electrodes and each backing may extend into the respective gap for electrical isolation thereof. Each electrode may be made from an electrically conductive material, such as gold, silver, copper, or aluminum. Leads, such as wires, may be connected to the respective electrodes and combine into a cable for extension to an electrical coupling connected to the bell. Each pair of wires or each cable may extend through respective conduits formed through the backing and the shell. Each backing may be bonded or molded to the respective vibratory element and electrodes. Electric cables 100*c,d* may connect the electrical couplings of the respective transducers 88*a,p* to the microcontroller MCU.

The protector may be bonded or molded to the respective peripheral electrode. Each jacket may be made from an injectable polymer and may bond the respective backing, peripheral electrode, and protector to the respective shell while electrically isolating the peripheral electrode therefrom. Each protector may be made from a polymer, such as an engineering polymer or epoxy, and also serve to electrically isolate the respective peripheral electrode from the crossover.

FIG. 14 illustrates cementing of the casing string 90 using the top drive system 1 in a cementing mode. As a shoe (not shown) of the casing string 90 nears a desired deployment depth of the casing string, such as adjacent a bottom of the lower formation, a casing hanger 90*h* may be assembled with the casing string 90. Once the casing hanger 90*h* reaches the rig floor 7*f*, the spider 75 may be set.

The casing unit 1*c* may be released from the motor unit 1*m* and replaced by the cementing unit 1*s* using the unit handler 4*u*. The work string 91 may be connected to the casing hanger 90*h* and the work string extended until the casing hanger 90*h* seats in the wellhead 76*h*. The work string 91 may include a casing deployment assembly (CDA) 91*d* and a stem 91*s*, such as such as one or more joints of drill pipe connected together, such as by threaded couplings. An upper end of the CDA 91*d* may be connected a lower end of the stem 91*s*, such as by threaded couplings. The CDA 91*d* may be connected to the casing hanger 90*h*, such as by engagement of a bayonet lug (not shown) with a mating bayonet profile (not shown) formed the casing hanger. The CDA 91*d* may include a running tool, a plug release system (not shown), and a packoff. The plug release system may include an equalization valve and a wiper plug. The wiper plug may be releasably connected to the equalization valve, such as by a shearable fastener.

Once the cementing unit 1*s* has been connected to the motor unit 1*m*, an upper end of the cement line 92 may be connected to an inlet of the cementing swivel 88*v*. A lower end of the cement line 92 may be connected to an outlet of a cement pump 93. A cement shutoff valve 92*v* and a cement pressure gauge 92*g* may be assembled as part of the cement line 92. An upper end of a cement feed line 94 may be connected to an outlet of a cement mixer 95 and a lower end of the cement feed line may be connected to an inlet of the cement pump 93.

Once the cement line 92 has been connected to the cementing swivel 88*v*, the fill up valve 50*f* may be closed and the drive motors 18 may be operated to rotate the work string 91 and casing string 90 during the cementing operation. The cement pump 93 may then be operated to inject conditioner 96 from the mixer 95 and down the casing string 90 via the feed line 94, the cement line 92, the cementing head 88, and a bore of the work string 91. Once the conditioner 96 has circulated through the wellbore 77, cement slurry 97 may be pumped from the mixer 95 into the cementing swivel 88*v* by the cement pump 93. The cement slurry 97 may flow into the launcher 88*h* and be diverted past the dart 89 (not shown) via the diverter and bypass passages.

The technician may operate the control console 62 to send a command signal to the microcontroller MCU during pumping of cement slurry 97. The command signal may instruct the dart detector to switch to an initialization mode for establishing a baseline. The microcontroller MCU may transmit input voltage pulses at an ultrasonic frequency to the active transducer 88*a* and record the amplitude and time of the transmission for each input voltage pulse. The active transducer 88*a* may then convert the voltage pulses into ultrasonic pulses. The ultrasonic pulses may travel through the adjacent crossover wall, through fluid contained in/flowing therethrough, and through the distal crossover wall to the passive transducer 88*p*. The passive transducer 88*p* may convert the received ultrasonic pulses into raw voltage pulses and supply the raw voltage pulses to the microcontroller MCU. The microcontroller MCU may refine the raw voltage pulses into output voltage pulses and calculate an amplitude ratio of each output pulse to the respective input pulse and calculate the transit time of each output pulse. The microcontroller MCU may then supply the calculated data to the transmitter TX for sending to the control console 62 via the antenna 55*a*. A programmable logic controller (PLC) of the control console 62 may process the data to determine the baseline.

Once the desired quantity of cement slurry 97 has been pumped, the dart 89 may be released from the launcher 88*h* by operating the launcher actuator. The chaser fluid 98 may be pumped into the cementing swivel 88*v* by the cement pump 93. The chaser fluid 98 may flow into the launcher 88*h* and be forced behind the dart 89 by closing of the bypass passages, thereby launching the dart.

Passing of the dart 89 through the dart detector may substantially decrease amplitudes of the baseline voltage pulses to reduced amplitude voltage pulses. The amplitude reduction may be caused by a substantial difference in acoustic impedance between the dart mandrel and the cement slurry 97 reflecting a portion of the pulses back toward the active transducer 88*a*. Passing of the dart 89 through the dart detector may substantially decrease the baseline transit times to faster transit times. The transit time reduction may be caused by increased acoustic velocity of the dart mandrel relative to the cement slurry 97. The control console 62 may detect passage of the dart 89 using either or both criteria and indicate successful launch of the dart by a visual indicator, such as a light or display screen.

Pumping of the chaser fluid 98 by the cement pump 93 may continue until residual cement in the cement line 92 has been purged. Pumping of the chaser fluid 98 may then be transferred to the mud pump 78 by closing the valve 92*v* and opening the fill up valve 50*f*. The dart 89 and cement slurry 97 may be driven through the work string bore by the chaser fluid 98. The dart 89 may land onto the wiper plug and continued pumping of the chaser fluid 98 may increase pressure in the work string bore against the seated dart 89 until a release pressure is achieved, thereby fracturing the shearable fastener. Continued pumping of the chaser fluid 98 may drive the dart 89, wiper plug, and cement slurry 97 through the casing bore. The cement slurry 97 may flow through a float collar (not shown) and the shoe of the casing string 90, and upward into the annulus.

Pumping of the chaser fluid 98 may continue to drive the cement slurry 97 into the annulus until the wiper plug bumps the float collar. Pumping of the chaser fluid 98 may then be halted and rotation of the casing string 90 may also be halted. The float collar may close in response to halting of the pumping. The work string 91 may then be lowered to set a packer of the casing hanger 90*h*. The bayonet connection may be released and the work string 91 may be retrieved to the rig 1*r*.

Alternatively, for a liner operation (not shown) or a subsea casing operation, the drilling unit 1*d* may be used again after the casing or liner string is assembled for assembling the work string used to deploy the assembled casing or liner string into the wellbore 77. The top drive system 1 may be shifted back to the drilling mode for assembly of the work string. The work string may include a casing or liner deployment assembly and a string of drill pipe such that the drilling unit 1*d* may be employed to assemble the pipe string. The motor unit 1*m* may be operated for reaming the casing or liner string into the wellbore 77.

Figure 15:
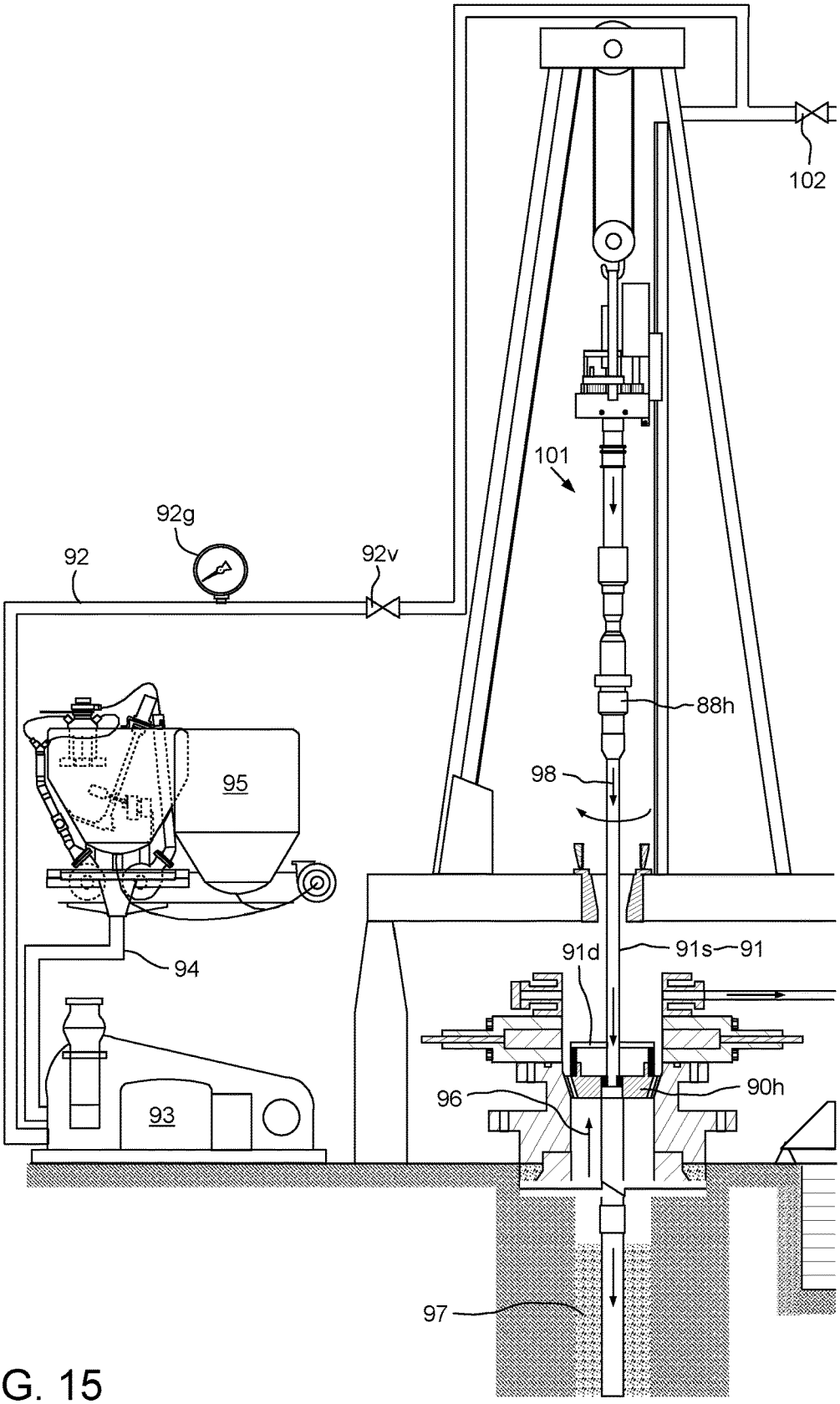
FIG. 15 illustrates cementing of the casing string using an alternative cementing unit, according to another embodiment of the present disclosure.

FIG. 15 illustrates cementing of the casing string 90 using an alternative cementing unit 101, according to another embodiment of the present disclosure. The alternative cementing unit 101 may include the coupling 15, the fill up valve 50*f* and actuator 50*a* (repurposed as an IBOP), the adapter 99, the genset 51, the frame 58, the hydraulic passages 49, and a modified cementing head. The modified cementing head may include the launcher 88*h*, a release plug, such as the dart 89, and the dart detector. The alternative cementing unit 101 may be similar to the cementing unit 1*s* except for omission of the cementing swivel 88*v*.

To accommodate omission of the cementing swivel 88*v*, a flow tee and shutoff valve 102 may be assembled as part of the standpipe 79 and the upper end of the cement line 92 may be connected to the flow tee. During the cementing operation, the shutoff valve 102 may be closed and the conditioner 96 and cement slurry 97 may be pumped by the cement pump 93 and through the cement line 92, mud hose, motor unit 1*m*, alternative cementing unit 101, work string 91, and casing string 90. Once the cement line 92 has been purged by the chaser fluid 98, the shutoff valve 92*v* may be closed and the shutoff valve 102 opened and the cementing operation may proceed as discussed above.

Alternatively, either cementing unit 1*s*, 101 may have a position sensor instead of or in addition to the dart detector and for verifying that the launcher actuator has properly moved the plunger to the release position.

Alternatively, the casing unit 1*c* and/or either cementing unit 1*s*, 101 may have its own control swivel and the hydraulic junction 36 may be omitted.

Alternatively, the motor unit 1*m* may have a wireless data link for relaying communication between the control console 62 and the control unit 55.

Alternatively, the fluid driven motor 52, gearbox 53, electric generator 54, and power converter 55*c* may be omitted and the battery 55*b* may have sufficient energy capacity to operate the casing unit 1*c* and/or either cementing unit 1*s*, 101 during the respective operations.

Alternatively, the genset 51 may further include an air compressor driven by the fluid driven motor 52 or the genset may include an electric motor for driving the air compressor.

Alternatively, the genset 51 may be used with any other accessory tool, such as a drilling unit, a completion tool, a wireline tool, a fracturing tool, a pump, or a sand screen.

In one embodiment, a system includes an accessory tool selected from a group consisting of a casing unit, a cementing unit, and a drilling unit; and a genset mounted to the accessory tool and comprising: a fluid driven motor having an inlet and an outlet for connection to a control swivel of the system; an electric generator connected to the fluid driven motor; a manifold having an inlet for connection to the control swivel and an outlet connected an accessory tool actuator; and a control unit in communication with the electric generator and the manifold and comprising a wireless data link.

In one or more embodiments described herein, the fluid driven motor is hydraulic.

In one or more embodiments described herein, the system also includes a fill up valve for opening and closing a bore of the accessory tool; and a fill up valve actuator for operating the fill up valve and connected to the outlet of the manifold.

In one or more embodiments described herein, the fill up valve actuator comprises a position sensor in communication with the control unit for monitoring operation of the fill up valve actuator.

In one or more embodiments described herein, the genset further comprises a gearbox connecting the fluid driven motor to the electric generator.

In one or more embodiments described herein, the fluid driven motor is a gerotor, the gearbox is a planetary gearbox, and the electric generator is a permanent magnet generator.

In one or more embodiments described herein, the wireless data link comprises an antenna.

In one or more embodiments described herein, the control unit further comprises at least one of: a power converter in electrical communication with the electric generator; a battery in electrical communication with the power converter; a microcontroller in electrical communication with the battery; a transmitter in electrical communication with the microcontroller and the antenna; and a receiver in electrical communication with the microcontroller and the antenna.

In one or more embodiments described herein, the control swivel is located on a motor unit of the system, the system further comprising: a rail for connection to a drilling rig; and the motor unit, comprising: a drive body; a drive motor having a stator connected to the drive body; a trolley for connecting the drive body to the rail; a drive ring torsionally connected to a rotor of the drive motor; and a swivel frame connected to the drive body and the control swivel.

In one or more embodiments described herein, the motor unit further comprises: a becket for connection to a hoist of the drilling rig; a mud swivel connected to the swivel frame; and a down thrust bearing for supporting the drive ring for rotation relative to the drive body.

In one or more embodiments described herein, the system also includes a unit handler locatable on or adjacent to a structure of the drilling rig and operable to retrieve the accessory tool from a rack and deliver the accessory tool to the motor unit.

In one or more embodiments described herein, the unit handler comprises: an arm; and a holder releasably connected to the arm and operable to carry the accessory tool.

In one or more embodiments described herein, the unit handler further comprises a pipe clamp releasably connected to the arm and operable to carry a casing joint or liner for delivery to the accessory tool.

In one or more embodiments described herein, the unit handler further comprises: a base for mounting the unit handler to a subfloor structure of the drilling rig; a post extending from the base to a height above a floor of the drilling rig; a slide hinge transversely connected to the post; and the arm connected to the slide hinge and comprising a forearm segment, an aft-arm segment, and an actuated joint connecting the arm segments.

In one or more embodiments described herein, the accessory tool is the casing unit; the casing unit comprises a clamp comprising: a set of grippers for engaging a surface of a casing joint; and a clamp actuator for selectively engaging and disengaging the set of grippers with the casing joint; the genset is mounted to the clamp; and the accessory tool actuator is the clamp actuator.

In one or more embodiments described herein, the casing unit further comprises a stab seal connected to the clamp for engaging an inner surface of the casing joint.

In one or more embodiments described herein, the clamp comprises a position sensor in communication with the control unit for monitoring operation of the clamp actuator.

In one or more embodiments described herein, the control swivel is located on a motor unit of the system, and the casing unit further comprises a coupling connected to the clamp and having a head with a latch profile for mating with a latch profile of the motor unit and having a plurality of fluid connectors for mating with fluid connectors of the motor unit.

In one or more embodiments described herein, the accessory tool comprises the cementing unit; the cementing unit comprises a cementing head comprising a launcher; the genset is mounted to the cementing head; and the accessory tool actuator is the launcher.

In one or more embodiments described herein, the cementing head further comprises a dart detector in communication with the control unit and for monitoring launching of a plug.

In one or more embodiments described herein, the dart detector comprises: an active transducer mounted to an outer surface of the launcher and operable to generate ultrasonic pulses; a passive transducer mounted to the outer surface of the launcher and operable to receive the ultrasonic pulses.

In one or more embodiments described herein, the cementing head further comprises a cementing swivel for allowing rotation of a tubular string during cementing.

In one or more embodiments described herein, the cementing swivel comprises: a housing having an inlet formed through a wall thereof for connection of a cement line; a mandrel having a port formed through a wall thereof in fluid communication with the inlet of the housing; a bearing for supporting rotation of the mandrel relative to the housing; and a seal assembly for isolating the fluid communication between the inlet of the housing and the port of the mandrel.

In one or more embodiments described herein, the launcher comprises: a launcher body connected to the mandrel of the cementing swivel; a dart disposed in the launcher body; and a gate having a portion extending into the launcher body for capturing the dart therein and movable to a release position allowing the dart to travel past the gate.

In one or more embodiments described herein, the launcher comprises a plunger movable between a capture position and a release position, wherein the launcher is operable to keep a plug retained therein in the capture position while allowing fluid flow therethrough, and to allow the fluid flow to propel the plug in the release position.

In one or more embodiments described herein, the control swivel is located on a motor unit of the system, and the cementing unit further comprises a coupling connected to the cementing head and having a head with a latch profile for mating with a latch profile of the motor unit and having a plurality of fluid connectors for mating with fluid connectors of the motor unit.

In one or more embodiments described herein, the system also includes an internal blowout preventer controlled by a second control unit at the accessory tool and powered by the genset.

In one embodiment, a casing unit for a top drive system includes a clamp and a genset mounted to the clamp. The clamp includes a set of grippers for engaging a surface of a casing joint; and a clamp actuator for selectively engaging and disengaging the set of grippers with the casing joint. The genset includes a fluid driven motor having an inlet and an outlet for connection to a control swivel of the top drive system; an electric generator connected to the fluid driven motor; a manifold having an inlet for connection to the control swivel and an outlet connected to the clamp actuator; and a control unit in communication with the electric generator and the manifold and having a wireless data link.

In another embodiment, a casing unit for a top drive system includes a clamp and an assembly mounted to the clamp. The clamp includes a set of grippers for engaging a surface of a casing joint; and a clamp actuator for selectively engaging and disengaging the set of grippers with the casing joint. The assembly includes a manifold having an inlet for connection to a control swivel of the top drive system and an outlet connected to the clamp actuator; and a control unit in communication with the manifold and having a battery and a wireless data link.

In another embodiment, a cementing unit for a top drive system includes a cementing head and a genset mounted to the cementing head. The cementing head includes a launcher: operable between a capture position and a release position, operable to keep a plug retained therein in the capture position while allowing fluid flow therethrough, and operable to allow the fluid flow to propel the plug in the release position. The genset includes a fluid driven motor having an inlet and an outlet for connection to a control swivel of the top drive system; an electric generator connected to the fluid driven motor; a manifold having an inlet for connection to the control swivel and an outlet connected to the launcher; and a control unit in communication with the electric generator and the manifold and having a wireless data link.

While the foregoing is directed to embodiments of the present disclosure, other and further embodiments of the disclosure may be devised without departing from the basic scope thereof, and the scope of the invention is determined by the claims that follow.

The invention claimed is:

1. A system comprising:

a motor unit including a control swivel;

an accessory tool releasably connected to the motor unit and selected from a group consisting of a casing unit, a cementing unit, and a drilling unit, wherein the accessary tool includes one or more hydraulic passages, and the one or more hydraulic passages are connected to the control swivel when the accessory tool is connected to the motor unit; and a genset mounted to the accessory tool and comprising:

a fluid driven motor having an inlet and an outlet for connection to the control swivel via the one or more hydraulic passages in the accessory tool;

an electric generator connected to the fluid driven motor;

a manifold having an inlet for connection to the control swivel and an outlet connected an accessory tool actuator; and a control unit in communication with the electric generator and the manifold and comprising a wireless data link.

2. The system of claim 1, wherein the fluid driven motor is hydraulic.

3. The system of claim 1, further comprising:

a fill up valve for opening and closing a bore of the accessory tool; and a fill up valve actuator for operating the fill up valve and connected to the outlet of the manifold.

4. The system of claim 3, wherein the fill up valve actuator comprises a position sensor in communication with the control unit for monitoring operation of the fill up valve actuator.

5. The system of claim 1, wherein the genset further comprises a gearbox connecting the fluid driven motor to the electric generator.

6. The system of claim 5, wherein:

the fluid driven motor is a gerotor, the gearbox is a planetary gearbox, and the electric generator is a permanent magnet generator.

7. The system of claim 1, wherein the wireless data link comprises an antenna.

8. The system of claim 7, wherein the control unit further comprises at least one of:

a power converter in electrical communication with the electric generator;

a battery in electrical communication with the power converter;

a microcontroller in electrical communication with the battery;

a transmitter in electrical communication with the microcontroller and the antenna; and a receiver in electrical communication with the microcontroller and the antenna.

9. The system of claim 1, wherein the control swivel is located on the motor unit of the system, the system further comprising:

a rail for connection to a drilling rig; and the motor unit, comprising:

a drive body;

a drive motor having a stator connected to the drive body;

a trolley for connecting the drive body to the rail;

a drive ring torsionally connected to a rotor of the drive motor; and a swivel frame connected to the drive body and the control swivel.

10. The system of claim 9, wherein the motor unit further comprises:

a becket for connection to a hoist of the drilling rig;

a mud swivel connected to the swivel frame; and a down thrust bearing for supporting the drive ring for rotation relative to the drive body.

11. The system of claim 9, further comprising a unit handler locatable on or adjacent to a structure of the drilling rig and operable to retrieve the accessory tool from a rack and deliver the accessory tool to the motor unit.

12. The system of claim 11, wherein the unit handler comprises:

an arm; and a holder releasably connected to the arm and operable to carry the accessory tool.

13. The system of claim 12, wherein the unit handler further comprises a pipe clamp releasably connected to the arm and operable to carry a casing joint or liner for delivery to the accessory tool.

14. The system of claim 13, wherein the unit handler further comprises:

a base for mounting the unit handler to a subfloor structure of the drilling rig;

a post extending from the base to a height above a floor of the drilling rig;

a slide hinge transversely connected to the post; and the arm connected to the slide hinge and comprising a forearm segment, an aft-arm segment, and an actuated joint connecting the arm segments.

15. The system of claim 1, wherein:

the accessory tool is the casing unit;

the casing unit comprises a clamp comprising:

a set of grippers for engaging a surface of a casing joint; and a clamp actuator for selectively engaging and disengaging the set of grippers with the casing joint;

the genset is mounted to the clamp; and the accessory tool actuator is the clamp actuator.

16. The system of claim 15, wherein the casing unit further comprises a stab seal connected to the clamp for engaging an inner surface of the casing joint.

17. The system of claim 15, wherein the clamp comprises a position sensor in communication with the control unit for monitoring operation of the clamp actuator.

18. The system of claim 15, wherein:

the control swivel is located on the motor unit of the system, and the casing unit further comprises a coupling connected to the clamp and having a head with a latch profile for mating with a latch profile of the motor unit and having a plurality of fluid connectors for mating with fluid connectors of the motor unit.

19. The system of claim 1, wherein:

the accessory tool comprises the cementing unit;

the cementing unit comprises a cementing head comprising a launcher;

the genset is mounted to the cementing head; and the accessory tool actuator is the launcher.

20. The system of claim 19, wherein the cementing head further comprises a dart detector in communication with the control unit and for monitoring launching of a plug.

21. The system of claim 20, wherein the dart detector comprises:

an active transducer mounted to an outer surface of the launcher and operable to generate ultrasonic pulses;

a passive transducer mounted to the outer surface of the launcher and operable to receive the ultrasonic pulses.

22. The system of claim 19, wherein the cementing head further comprises a cementing swivel for allowing rotation of a tubular string during cementing.

23. The system of claim 22, wherein the cementing swivel comprises:

a housing having an inlet formed through a wall thereof for connection of a cement line;

a mandrel having a port formed through a wall thereof in fluid communication with the inlet of the housing;

a bearing for supporting rotation of the mandrel relative to the housing; and a seal assembly for isolating the fluid communication between the inlet of the housing and the port of the mandrel.

24. The system of claim 23, wherein the launcher comprises:

a launcher body connected to the mandrel of the cementing swivel;

a dart disposed in the launcher body; and a gate having a portion extending into the launcher body for capturing the dart therein and movable to a release position allowing the dart to travel past the gate.

25. The system of claim 19, wherein the launcher comprises a plunger movable between a capture position and a release position, wherein the launcher is operable to keep a plug retained therein in the capture position while allowing fluid flow therethrough, and to allow the fluid flow to propel the plug in the release position.

26. The system of claim 19, wherein:

the control swivel is located on the motor unit of the system, and the cementing unit further comprises a coupling connected to the cementing head and having a head with a latch profile for mating with a latch profile of the motor unit and having a plurality of fluid connectors for mating with fluid connectors of the motor unit.

27. The system of claim 1, further comprising an internal blowout preventer controlled by a second control unit at the accessory tool and powered by the genset.

* * * * *